US012117021B2

(12) United States Patent
Jung et al.

(10) Patent No.: US 12,117,021 B2
(45) Date of Patent: Oct. 15, 2024

(54) BLOWER

(71) Applicant: LG ELECTRONICS INC., Seoul (KR)

(72) Inventors: Jaehyuk Jung, Seoul (KR); Seokho Choi, Seoul (KR); Hyungho Park, Seoul (KR); Hoojin Kim, Seoul (KR); Inbeom Cheon, Seoul (KR); Changhoon Lee, Seoul (KR); Juhyun Kim, Seoul (KR); Yongmin Kim, Seoul (KR); Chiyoung Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 202 days.

(21) Appl. No.: 17/335,810

(22) Filed: Jun. 1, 2021

(65) Prior Publication Data

US 2021/0372437 A1 Dec. 2, 2021

(30) Foreign Application Priority Data

Jun. 2, 2020 (KR) ..... 10-2020-0066278
Jun. 2, 2020 (KR) ..... 10-2020-0066279
(Continued)

(51) Int. Cl.
*F04D 29/70* (2006.01)
*F04D 25/08* (2006.01)
(Continued)

(52) U.S. Cl.
CPC ..... *F04D 29/703* (2013.01); *F04D 25/08* (2013.01); *F04D 29/441* (2013.01); *F04F 5/16* (2013.01)

(58) Field of Classification Search
CPC ..... F04D 29/703; F04D 25/08; F04D 29/441; F04F 5/16
See application file for complete search history.

(56) References Cited

U.S. PATENT DOCUMENTS

2010/0226801 A1* 9/2010 Gammack ..... F04D 25/08 417/423.1
2012/0051884 A1* 3/2012 Junkel ..... F04F 5/16 415/90
(Continued)

FOREIGN PATENT DOCUMENTS

CN 1462205 12/2003
CN 204469444 7/2015
(Continued)

OTHER PUBLICATIONS

Taiwanese Office Action issued in Application No. 110120105 dated Feb. 9, 2022.
(Continued)

*Primary Examiner* — Grant Moubry
*Assistant Examiner* — Ruben Picon-Feliciano
(74) *Attorney, Agent, or Firm* — KED & ASSOCIATES, LLP

(57) ABSTRACT

A blower may include a body or case having a suction hole through which air passes, a fan provided inside the body and causing a flow of air, and a filter provided inside the body. The filter may be positioned upstream of the fan and extend in a longitudinal direction of the body. A longitudinal axis of the filter may be shifted or displaced with respect to a longitudinal axis of the body.

19 Claims, 23 Drawing Sheets

(30) Foreign Application Priority Data

| | | |
|---|---|---|
| Jun. 2, 2020 | (KR) | 10-2020-0066280 |
| Jun. 15, 2020 | (KR) | 10-2020-0072338 |
| Sep. 15, 2020 | (KR) | 10-2020-0118174 |

(51) Int. Cl.

| | |
|---|---|
| ***F04D 29/44*** | (2006.01) |
| ***F04F 5/16*** | (2006.01) |

(56) References Cited

U.S. PATENT DOCUMENTS

| | | | | |
|---|---|---|---|---|
| 2014/0147297 | A1* | 5/2014 | Iyer | F04F 5/14 417/158 |
| 2022/0074419 | A1* | 3/2022 | Pouget | F24F 13/26 |

FOREIGN PATENT DOCUMENTS

| | | |
|---|---|---|
| CN | 106051948 | 10/2016 |
| CN | 107023884 | 8/2017 |
| CN | 107131574 | 9/2017 |
| CN | 206877265 | 1/2018 |
| CN | 107702212 | 2/2018 |
| CN | 111156623 | 5/2020 |
| EP | 3257566 | 12/2017 |
| GB | 386132 | 1/1933 |
| JP | 2000-257904 | 9/2000 |
| JP | 2016-142475 | 8/2016 |
| KR | 10-2011-0099318 | 9/2011 |
| KR | 10-2013-0033435 | 4/2013 |
| KR | 10-2018-0125425 | 11/2018 |
| KR | 10-2019-0093537 | 8/2019 |
| KR | 10-2020-0085846 | 7/2020 |
| WO | WO 2018/014779 | 1/2018 |

OTHER PUBLICATIONS

Korean Office Action dated Apr. 6, 2023 issued in Application No. 10-2020-0066278.

Korean Office Action dated Apr. 6, 2023 issued in Application No. 10-2020-0066279.

Korean Office Action dated Apr. 6, 2023 issued in Application No. 10-2020-0072338.

European Search Report dated Oct. 25, 2021 issued in Application No. 21177391.6.

Korean Office Action dated Nov. 1, 2021 issued in Application No. 10-2020-0118174.

Chinese Office Action dated Nov. 3, 2022 issued in CN Application No. 202110608725.9.

* cited by examiner

BLOWER

CROSS-REFERENCE TO RELATED APPLICATION(S)

This application claims the priority benefit of Korean Patent Application 10-2020-0066278, filed in Korea on Jun. 2, 2020, Korean Patent Application 10-2020-0066279, filed in Korea on Jun. 2, 2020, Korean Patent Application 10-2020-0066280, filed in Korea on Jun. 2, 2020, Korean Patent Application 10-2020-0072338, filed in Korea on Jun. 15, 2020, and Korean Patent Application 10-2020-0118174, filed in Korean On Sep. 15, 2020, the entire disclosures of all of which are hereby expressly incorporated by reference into the present application.

BACKGROUND

1. Field

The present disclosure relates to a blower.

2. BACKGROUND

A blower may generate an air flow to circulate air in a room or to guide air toward users. Recent studies have been conducted on an air discharge structure of a blower to provide comfort.

Korean Laid-Open Patent Publication Nos. KR2011-0099318 and KR2020-0085846 disclose a blower or a fan to blow air by using the Coanda effect. A blower may have an air purification filter. However, there is a lack of research on methods of maximizing a volume of the filter in a space where the filter is installed. A blower may provide a grille to prevent a user's finger from interfering with the fan after the filter is removed from the blower. However, there is a lack of research on methods of reducing noise or increasing air flow resistance caused by the use of the grille.

BRIEF DESCRIPTION OF THE DRAWINGS

Embodiments will be described in detail with reference to the following drawings in which like reference numerals refer to like elements, and wherein:

FIGS. 8 and 9 are diagrams explaining a diffused air flow generated when a blower is in a first state, in which FIG. 8 is a top view of the blower, and FIG. 9 is a perspective view of the blower with the diffused air flow indicated by a dotted line arrow;

FIGS. 10 and 11 are diagrams explaining an upward air flow generated when a blower is in a second state, in which FIG. 10 is a top view of the blower, and FIG. 11 is a perspective view of the blower with the upward air flow indicated by a dotted line arrow;

DETAILED DESCRIPTION

Figure 1:
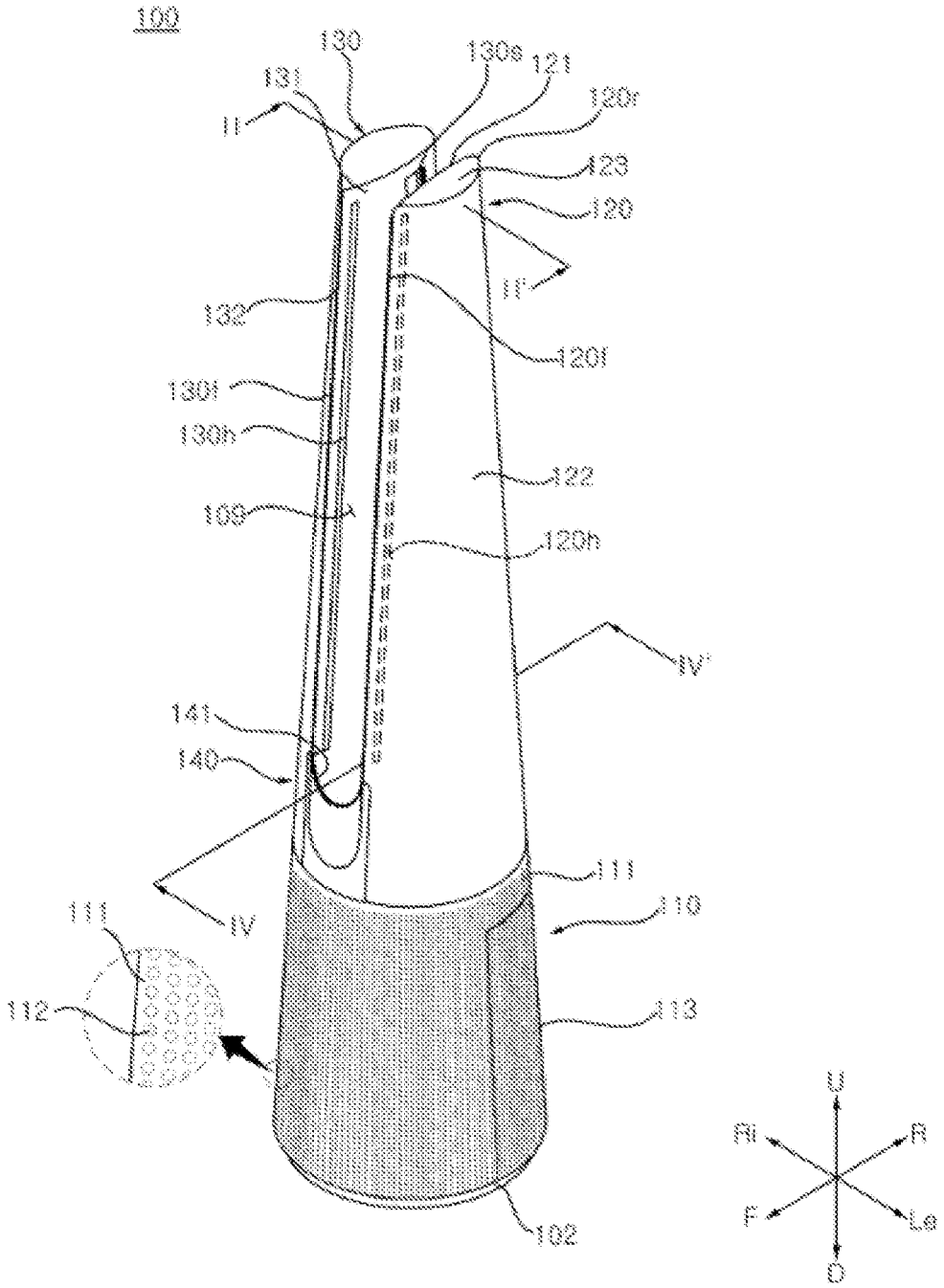
FIG. 1 is a perspective view of a blower according to an embodiment.

Referring to FIG. 1, a blower 100 may be elongated in an up-down or vertical direction. The blower 100 may include a base 102, a lower body or case 110, a first upper case or tower 120, and a second upper case or tower 130. The first and second upper bodies 120 and 130 may also be referred to as first and second extensions or bodies.

The base 102 may form a bottom surface of the blower 100 and may be placed on a floor or ground surface of a space to be treated (e.g., an indoor space). The base 102 may have an overall circular plate shape.

The lower body 110 may be provided above the base 102. The lower body 110 may form a lower portion of a side surface of the blower 100. The lower body 110 may have an overall cylindrical shape. For example, a diameter of the lower body 110 may decrease from the bottom toward the top of the lower body 110. As an alternative example, a diameter of the lower body 110 may remain constant in the up-down direction. At least one suction hole 112 may be formed through the side surface of the lower body 110. For example, a plurality of suction holes 112 may be provided uniformly along a circumferential direction of the lower body 110 such that air may flow from an outside into an interior of the blower 100 through the plurality of suction holes 112.

The first and second upper bodies 120 and 130 may be provided above the lower body 110. The first and second upper bodies 120 and 130 may each have an inner space or a passage communicating with an inner space of the lower body 110.

The first and second upper bodies 120 and 130 may be spaced apart from each other. In an alternative example, there may be more than two upper bodies 120 and 130. In yet another alternative example, the upper bodies 120 and 130 may be formed as a single upper body. In this case, the upper bodies 120 and 130 may be elongated in the up-down direction from the top of the lower body 110, or may be formed as a ring or an open ring having a circular, elliptical, or track shape. A position of the single upper body 120 and 130 with respect to the lower body 110 may be determined in consideration of a shape of the upper body 120 and 130, and a position, shape, and number of air discharge holes formed in the upper body 120 and 130.

For convenience of explanation, the following description will be made based on an example where there are two upper bodies 120 and 130 which include the first upper body 120 and the second upper body 130. A description thereof may be applied not only to a case where the upper bodies 120 and 130 are two in number, but also to a case where the upper bodies 120 and 130 are formed as a single upper body, or alternatively, more than two.

The first upper body 120 and the second upper body 130 may be provided above the lower body 110. The first upper body 120 and the second upper body 130 may form an upper portion of a side surface of the blower 100. The first upper body 120 and the second upper body 130 may be elongated in the up-down direction (U-D in FIG. 1) and may be spaced apart from each other in a left-right direction (Ri-Le in FIG. 1). A space 109 may be formed between the first upper body 120 and the second upper body 130 to provide an air passage. In addition, the space 109 may be referred to as a blowing space, a valley, or a channel.

The first upper body 120 may be spaced apart leftward from the second upper body 130. The first upper body 120 may be elongated in the up-down direction. A first boundary or inner surface 121 of the first upper body 120 may be directed toward the space 109 and may define a portion of the boundary of the space 109. The first boundary surface 121 of the first upper body 120 may be a curved surface which is convex in a direction from the first upper body 120 toward the space 109, i.e., a curved surface which is convex to the right. A first outer surface 122 of the first upper body 120 may be provided opposite the first boundary surface 121 of the first upper body 120. The first outer surface 122 of the first upper body 120 may be a curved surface which is convex in a direction opposite the direction from the first upper body 120 toward the space 109, i.e., a curved surface which is convex to the left.

For example, the first boundary surface 121 of the first upper body 120 may be elongated in the up-down direction. The first outer surface 122 of the first upper body 120 may extend toward the space 109 with respect to a vertical line extending in the up-down direction. The first outer surface 122 may extend obliquely at a predetermined angle (e.g., an acute angle) to the right side.

A curvature of the first outer surface 122 of the first upper body 120 may be greater than a curvature of the first boundary surface 121 of the first upper body 120. The first boundary surface 121 of the first upper body 120 may join with the first outer surface 122 of the first upper body 120 to form an edge. The edge may be formed over a front end 120*f* and a rear end 120*r* of the first upper body 120. For example, the front end 120*f* may extend obliquely at a predetermined angle (e.g., acute angle) toward a rear side with respect to a vertical line extending in the up-down direction. The rear end 120*r* may extend obliquely at a predetermined angle (e.g., acute angle) toward a front side with respect to the vertical line extending in the up-down direction.

The second upper body 130 may be spaced apart rightward from the first upper body 120. The second upper body 130 may be elongated in the up-down direction. A second boundary or inner surface 131 of the second upper body 130 may be directed toward the space 109, and may define a portion of the boundary of the space 10. The second boundary surface 131 of the second upper body 130 may be a curved surface which is convex in a direction from the second upper body 130 toward the space 109, i.e., a curved surface which is convex to the left. A second outer surface 132 of the second upper body 130 may be provided opposite the second boundary surface 131 of the second upper body 130. The second outer surface 132 of the second upper body 130 may be a curved surface which is convex in a direction opposite the direction from the second upper body 130 toward the space 109, i.e., a curved surface which is convex to the right.

For example, the second boundary surface 131 of the second upper body 130 may be elongated in the up-down direction. The second outer surface 132 of the second upper body 130 may extend obliquely at a predetermined angle (e.g., acute angle) to the left side. The second outer surface 132 may extend toward the space 109 with respect to the vertical line extending in the up-down direction.

A curvature of the second outer surface 132 of the second upper body 130 may be greater than a curvature of the second boundary surface 131 of the second upper body 130. The second boundary surface 131 of the second upper body 130 may meet or join with the second outer surface 132 of the second upper body 130 to form an edge. The edge may be formed over a front end 130*f* and a rear end 130*r* of the second upper body 130. For example, the front end 130*f* may extend obliquely at a predetermined angle (e.g., acute angle) toward a rear side with respect to the vertical line extending in the up-down direction. For example, the rear end 130*r* may extend obliquely at a predetermined angle (e.g., acute angle) toward a front side with respect to the vertical line extending in the up-down direction.

The first upper body 120 and the second upper body 130 may be bilaterally symmetrical with respect to the space 109 therebetween. The first outer surface 122 of the first upper body 120 and the second outer surface 132 of the second upper body 130 may be provided on an imaginary curved surface extending along an outer circumferential surface 111 of the lower body 110. The first outer surface 122 of the first upper body 120 and the second outer surface 132 of the second upper body 130 may be connected smoothly to the outer circumferential surface 111 of the lower body 110. An upper surface of the first upper body 120 and an upper surface of the second upper body 130 may be formed as horizontal surfaces. The blower 100 may have an overall truncated cone shape, thereby reducing a risk of overturning or tipping over of the blower 100 due to an external impact.

A groove or cutout 141 may be provided between the first upper body 120 and the second upper body 130 and may extend in a front-rear direction. The groove 141 may be a curved surface which is downwardly convex. The groove 141 may have a first side 141*a* (see FIG. 5) connected to a bottom side of the first boundary surface 121 of the first upper body 120, and a second side 141*b* (see FIG. 5) connected to a bottom side of the second boundary surface 131 of the second upper body 130. The groove 141 may form a portion of the boundary of the space 109. Air, flowing in the lower body 110, may be distributed by a fan 150 described later to an inner space of the first upper body 120 and an inner space of the second upper body 130 with the groove 141 provided therebetween. The groove 141 may be referred to as a connecting groove or a connecting surface.

A cover 113 may be removably coupled to the lower body 110. The cover 113 may be formed as a portion of the lower body 110. When the cover 1113 is separated from the lower body 110, a user may have access to an inner space of the lower body 110. When the cover 113 is removed, the user may remove, replace, repair, wash, and/or install a filter 103 described later in the lower body 110. Some of the suction holes 112 may also be formed in the cover 113.

A display may be provided on a front portion of the lower body 110 to display operating information of the blower 100 or to provide an interface that receives a user command. For example, the display may have a touch panel.

Figure 2:
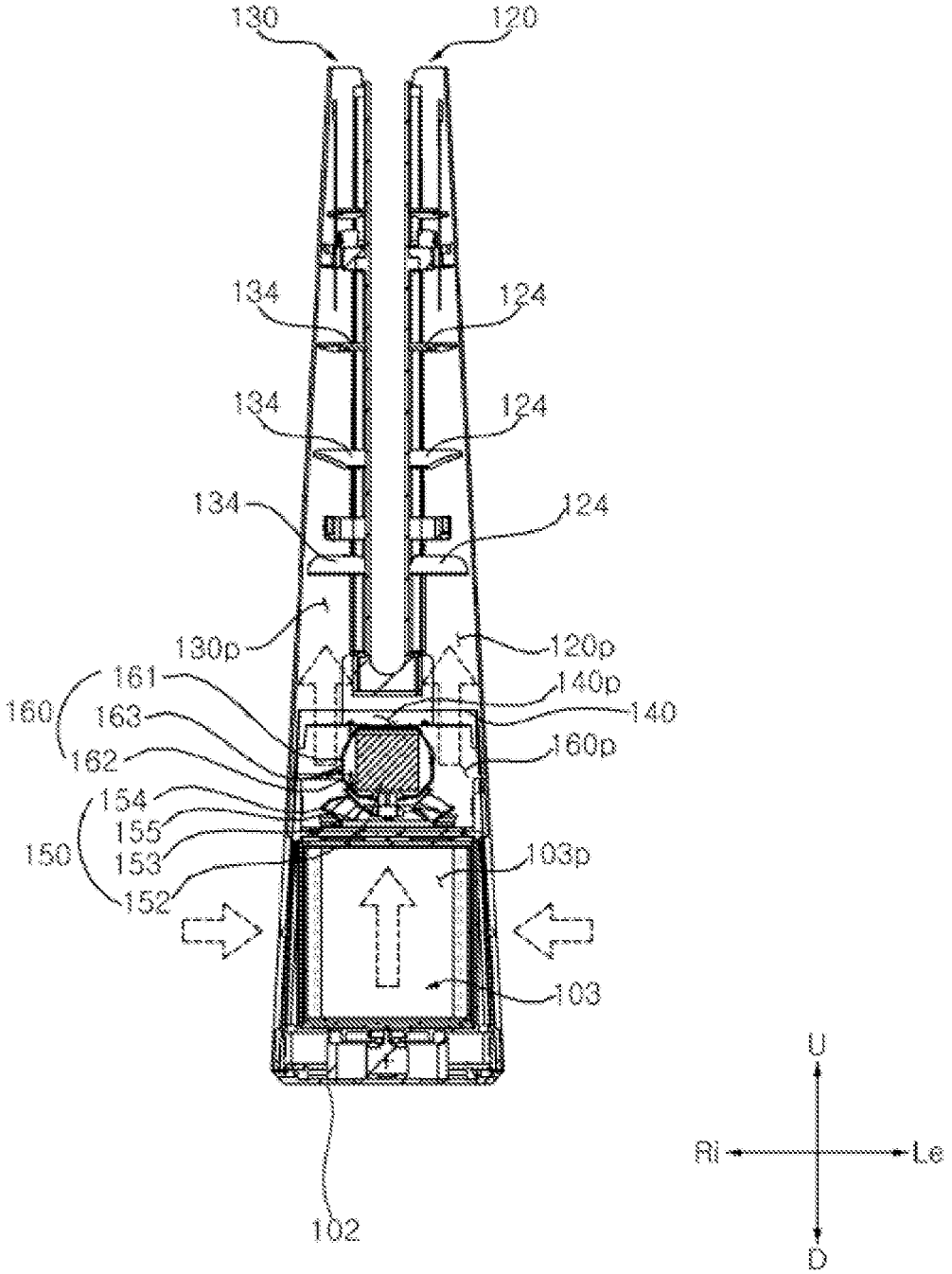
FIG. 2 is a view showing a cross-section cut along line II-II' of FIG. 1.

Referring to FIG. 2, the lower body 110 may provide an inner space in which the filter 103, the fan 150, and an air guide 160 be described below are installed or located. The filter 103 may be removably mounted in the inner space of the lower body 110. For example, the filter 103 may have an overall cylindrical shape. The filter 103 may have a hole 103*p* vertically penetrating the filter 103. Indoor or ambient air may be suctioned into the lower body 110 through the suction hole 112 (see FIG. 1) by an operation of the fan 150. Air flowing into the lower body 110 may be purified or filtered while flowing from an outer circumferential surface of the filter 103 to an inner circumferential surface of the filter 103 and may flow upward through the hole 103*p*.

The fan 150 may be mounted in the inner space of the lower body 110 above the filter 103. The filter 103 may be provided upstream of the fan 150. The fan 150 may cause a flow of air which flows into the blower 100 or which is discharged outside of the blower 100. The fan 150 may include a fan housing 151 (see FIG. 21), a fan motor 152, a hub 153, a shroud 154, and a blade 155. The fan 150 may be referred to as a fan assembly or a fan module.

The fan housing 151 may form an exterior of the fan 150. The fan housing 151 may include an inlet formed by vertically passing through the fan housing 151. The inlet may be formed at a lower end of the fan housing 151, and may be formed on an inside of a bell mouth 171 (see FIG. 13).

The fan motor 152 may provide torque. The fan motor 152 may be a motor of a centrifugal fan or a mixed flow fan. The fan motor 152 may be supported by a motor cover 162 described later. A rotating shaft of the fan motor 152 may extend downward from the fan motor 152 to pass through a lower surface of the motor cover 162. The hub 153, coupled with the rotating shaft, may rotate along with the rotating shaft. The shroud 154 may be spaced apart from the hub 154. A plurality of blades 155 may be provided between the shroud 154 and the hub 153. When the fan motor 152 is driven, air may be introduced in an axial direction (longitudinal direction of the rotating shaft) of the fan motor 152 through the inlet and may be discharged upwardly in a radial direction of the fan motor 152.

The air guide 160 may provide a passage 160*p* through which the air discharged from the fan 150 flows. As an example, the passage 160*p* may be an annular shaped passage. The air guide 160 may include a guide body 161, a motor cover 162, and a guide vane 163. The guide vane 163 may alternatively be referred to as a diffuser.

The guide body 161 may form the exterior of the air guide 160. The motor cover 162 may be provided at the center of the air guide 160. For example, the guide body 161 may have a cylindrical and/or bowl shape. The annular shaped passage 160*p* may be provided between the guide body 161 and the motor cover 162. The guide vane 163 may guide air provided to the passage 160*p* from the fan 150 to flow upward. The plurality of guide vanes 163 may be provided in the annular shaped passage 160*p* and may be spaced apart from each other in a circumferential direction of the guide body 161. Each of the plurality of guide vanes 163 may extend to an inner circumferential surface of the guide body 161 from an outer surface of the motor cover 162.

A distribution unit or distributor 140 may be provided above the air guide 160 between the lower body 110 and the upper bodies 120 and 130. The distribution unit 140 may provide a passage 140*p* through which air that has passed through the air guide 160 flows. The air may be distributed to the first upper body 120 and the second upper body 130 by the distribution unit 140. The air guide 160 may guide the air, circulated by the fan 150, toward the distribution unit 140, and the distribution unit 140 may guide the air, introduced from the air guide 160, to the first upper body 120 and the second upper body 130. The groove 141 (FIG. 1) may form a portion of the outer surface of the distribution unit 140. The distribution unit 140 may alternatively be referred to as a middle body, an inner body, or a tower base.

The first upper body 120 and the second upper body 130 may be bilaterally symmetrical to each other. The first upper body 120 may provide a first passage 120*p* through which the air that has passed through the air guide 160 may flow. The first passage 120*p* may be formed in the inner space of the first upper body 120. The second upper body 130 may provide a second passage 130*p* through which air that has passed through the air guide 160 may flow. The second passage 130*p* may be formed in the inner space of the second upper body 130. The first passage 120*p* and the second passage 130*p* may communicate with the passage 140*p* of the distribution unit 140 and the passage 160*p* of the air guide 160.

Figure 3:
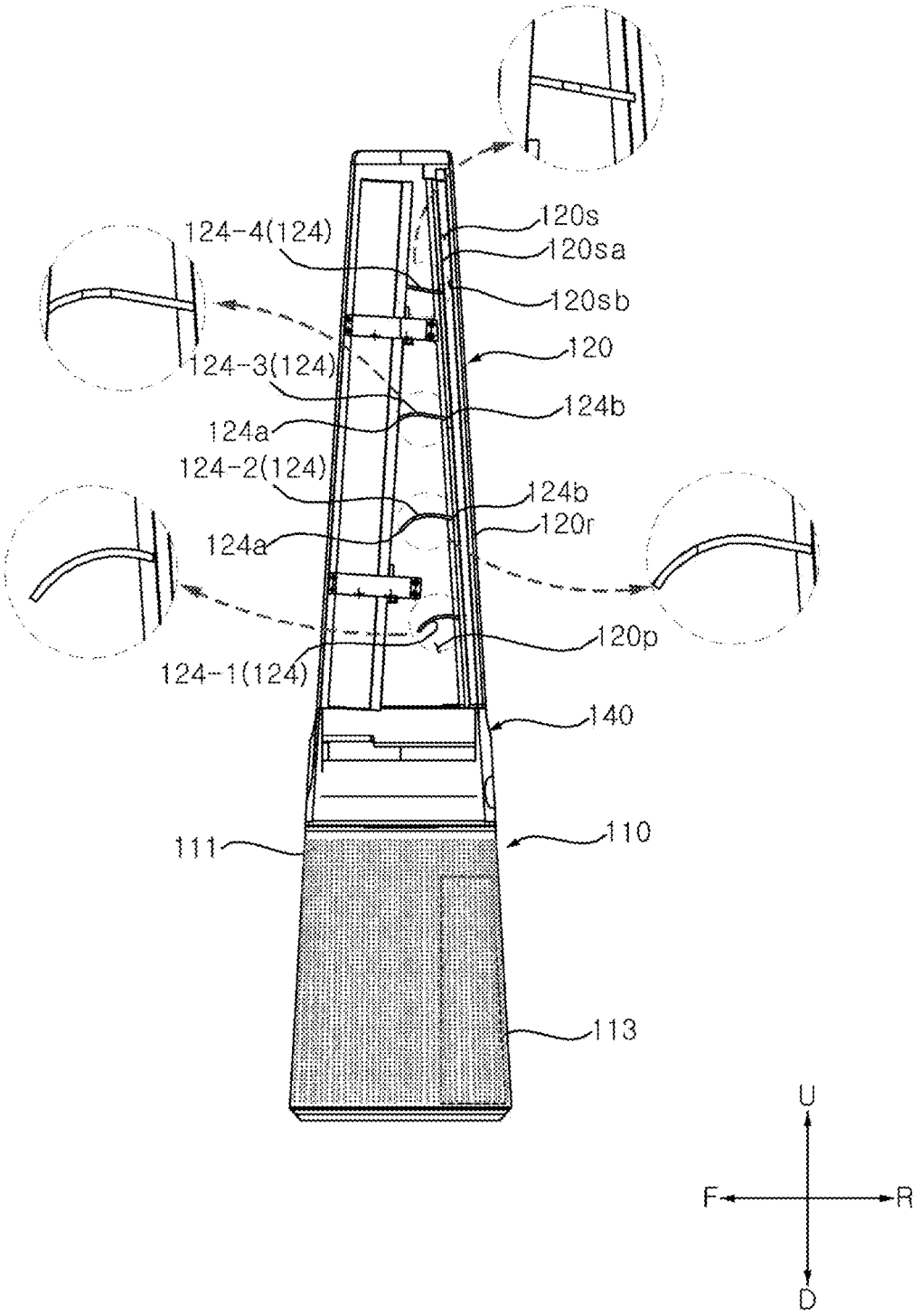
FIG. 3 is a left side view of a blower from which an outer wall of a first upper body is removed according to an embodiment.

Referring to FIGS. 1 and 3, a first slit 120*s* may discharge air flowing through the first passage 120*p* to the space 109. The first slit 120*s* may be provided adjacent to the rear end 120*r* of the first upper body 120 to pass through the first boundary surface 121 of the first upper body 120. The first slit 120*s* may be elongated along the rear end 120*r* of the first upper body 120. As an example, the first slit 120*s* may be hidden from a user's view looking at the rear side from the front side of the blower 100.

The first slit 120*s* may be inclined forward at a predetermined angle (e.g., an acute angle) with respect to the vertical line extending in the up-down direction. The first slit 120*s* may be parallel to the rear end 120*r* of the first upper body 120. As an alternative example, the first slit 120*s* may not be parallel to the rear end 120*r* of the first upper body 120, and a slope of the first slit 120*s* with respect to the vertical line may be greater than a slope of the rear end 120*r*.

Figure 4:
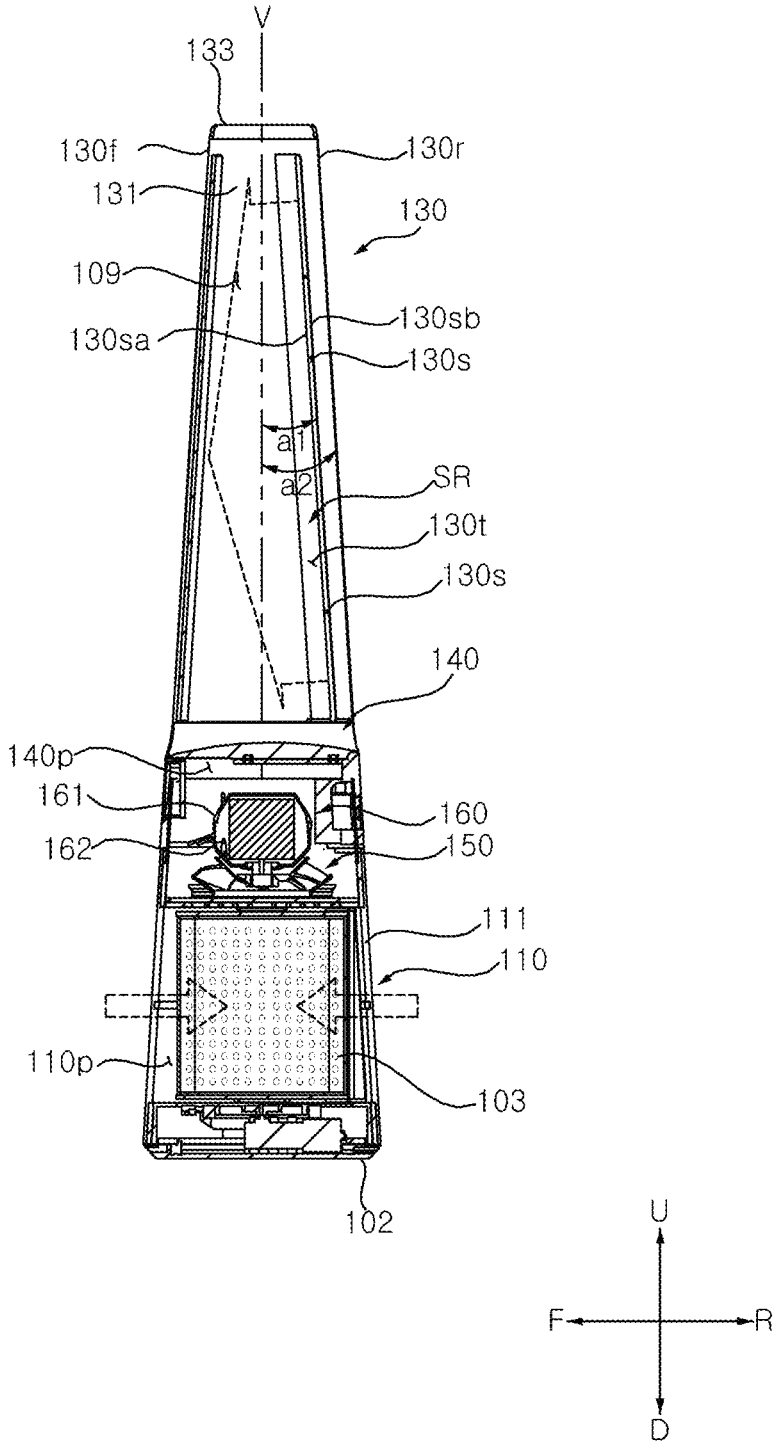
FIG. 4 is a view showing a cross-section cut along line IV-IV' of FIG. 1.

Referring to FIGS. 1, 2, and 4, a second slit 130*s* may discharge air flowing through the second passage 130*p* to the space 109. The second slit 130*s* may be provided adjacent to the rear end 130*r* of the second upper body 130 to pass through the second boundary surface 131 of the second upper body 130. The second slit 130*s* may be elongated along the rear end 130*r* of the second upper body 130. For example, the second slit 130*s* may be hidden from a user's view looking at the rear side from the front side of the blower 100.

The second slit 130*s* may be inclined forward at a predetermined angle (e.g., an acute angle) with respect to the vertical line extending in the up-down direction. The second slit 130*s* may be parallel to the rear end 130*r* of the second upper body 130. As an alternative example, the second slit 130*s* may not be parallel to the rear end 130*r* of the second upper body 130. The second slit 130*s* may be included at a first angle a1 (e.g., 4 degrees) with respect to the vertical line, and the rear end 130*r* may be included at a second angle a2 (e.g., 3 degrees), which is less than the first angle a1, with respect to the vertical line. The first slit 120*s* (see FIG. 3) and the second slit 130*s* may face each other and may be bilaterally symmetrical to each other.

Referring back to FIGS. 2 and 3, the vanes 123 and 134 may be mounted or provided in the inner space of the first upper body 120 and the inner space of the second upper body 130 to guide an air flow. The first vane 124 may guide air flowing upward in the first passage 120*p* to the first slit 120*s*. The first vane 124 may be provided adjacent to the first slit 120*s* and may be fixed to an inner surface of the first upper body 120. The first vane 124 may have an upwardly convex shape. The first vane 124 may include a plurality of first vanes 124 which are spaced apart from each other in the up-down direction. Each of the plurality of first vanes 124 may have one or a first end neighboring the first slit 120*s* and another or a second end opposite to the first end. The plurality of first vanes 124 may be spaced apart from each other along the first slit 120*s*. The plurality of first vanes 124 may have different shapes.

For example, among the plurality of first vanes 124, a curvature of a vane provided at a relatively lower position may be greater than a curvature of a vane provided at a relatively higher position. Among the plurality of first vanes 124, a position of the second end of the vane provided at a relatively lower position may be equal to or lower than the first end. A position of the second end of the vane provided at a relatively higher position may be equal to or higher than the first end. The first vanes 124 may smoothly guide the air flowing upward from the first passage 120*p* to the first slit 120*s*.

The second vane 124 may guide air flowing upward in the second passage 130*p* to the second slit 130*s*. The second vane 134 may be provided adjacent to the second slit 130*s* and may be fixed to an inner surface of the second upper body 130. The second vane 134 may have an upwardly convex shape. The second vane 134 may include a plurality of second vanes 134 which are spaced apart from each other in the up-down direction. Each of the plurality of second vanes 134 may have one or a first end neighboring to the second slit 130*s* and another or a second end opposite to the first end. The plurality of second vanes 134 may be spaced apart from each other along the second slit 130*s*. The plurality of second vanes 134 may have different shapes.

For example, among the plurality of second vanes 134, a curvature of a vane provided at a relatively lower position may be greater than a curvature of a vane provided at a relatively upper position. Among the plurality of second vanes 134, a position of the second end of the vane provided at a relatively lower position may be equal to or lower than the first end. A position of the second end of the vane provided at a relatively upper position may be equal to or higher than the one end. The second vanes 134 may smoothly guide the air flowing upward from the second passage 130*p* to the second slit 130*s*.

Figure 5:
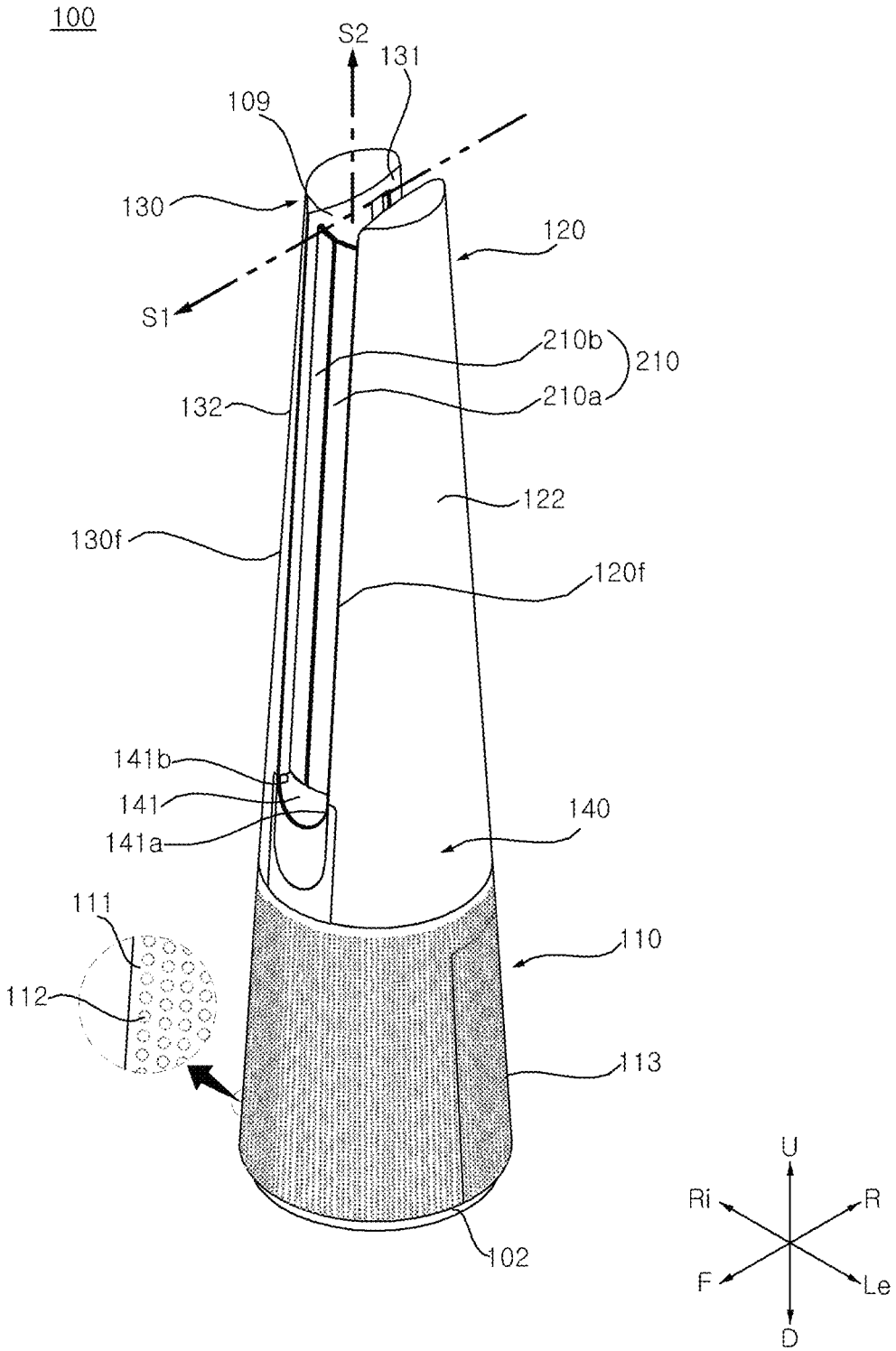
FIG. 5 is a perspective view of a damper closing a front part of a space of a blower according to an embodiment.
Figure 6:
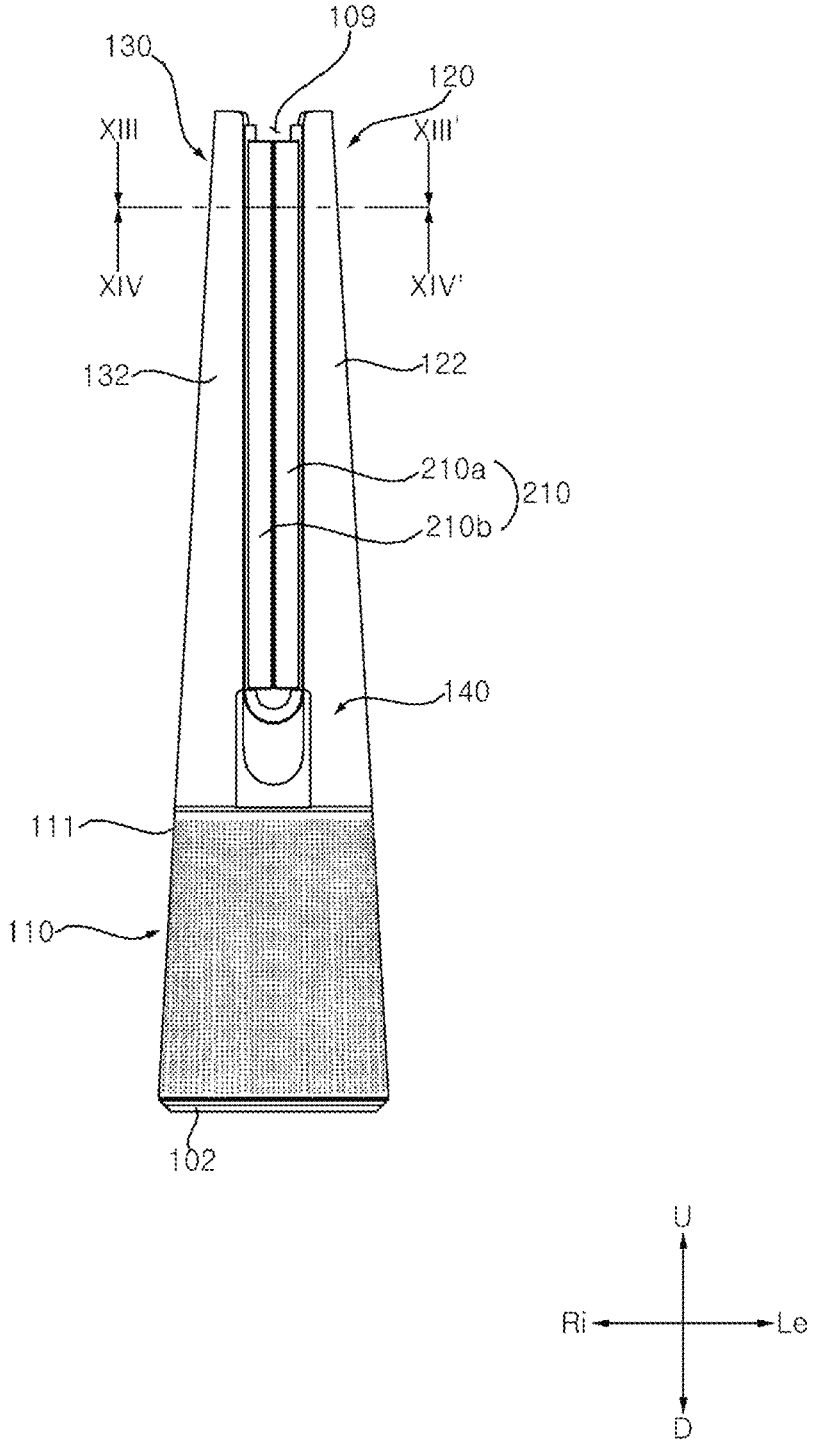
FIG. 6 is a front view of the blower of FIG. 5.

Referring to FIGS. 5 and 6, a damper or gate 210 may be movably coupled to the first upper body 120 and/or the second upper body 130. The damper 210 may protrude from the first upper body 120 and/or the second upper body 130 toward the space 109. The damper 210 may be flat or may be curvedly formed. For example, the damper 210 may be an outwardly convex plate. For example, the damper 210 may include a first damper 210*a* and a second damper 210*b*.

The first damper 210*a* may pass through a first slot or slit 120*h* (FIG. 7) to protrude into the space 109 or may pass through the first slot 120*h* to be inserted into the first upper body 120. By closing the first slot 120*h*, the first damper 210*a* may prevent air flowing through the first passage 120*p* from escaping to the outside through the first slot 120*h*. Here, the first slot 120*h* may be provided adjacent to the front end 120*f* of the first upper body 120 and pass through the first boundary surface 121 of the first upper body 120. The first slot 120*h* may be elongated along the front end 120*f* of the first upper body 120.

For example, the first slot 120*h* may be parallel to the front end 120*f*. Alternatively, the first slot 120*h* may not parallel to the front end 120*f*, and a slope of the first slot 120*h* with respect to a vertical line may be greater than a slope of the front end 120*f*. The first slot 120*h* may also be referred to as a first board slit or first gate slit.

The second damper 210*b* may pass through a second slot or slit 130*h* (FIG. 7) to protrude into the space 109 or may pass through the second slot 130*h* to be inserted into the second upper body 130. By closing the second slot 130*h*, the second damper 210*b* may prevent air flowing through the second passage 130*p* from escaping to the outside through the second slot 130*h*. Here, the second slot 130*h* may be provided adjacent to the front end 130*f* of the second upper body 130 to pass through the second boundary surface 131 of the second upper body 130. The second slot 130*h* may be elongated along the front end 130*f* of the second upper body 130.

The second slot 130*h* may be parallel to the front end 130*f*. Alternatively, the second slot 130*h* may not be parallel to the front end 130*f* and a slope of the second slot 130*h* with respect to the vertical line may be greater than a slope of the front end 130*f*. The second slot 130*h* may also be referred to as a second board or gate slit.

The first slot 120*h* and the second slot 130*h* may face each other, and the first damper 210*a* and the second damper 210*b* may be in contact with each other or may be spaced apart from each other. When the first damper 210*a* and the second damper 210*b* are provided in the space 109, the first damper 210*a* and the second damper 210*b* may cover or close at least a portion of the front part of the space 109.

The damper 210 may be moved manually by a user with respect to the first upper body 120 and/or the second upper body 130. Alternatively, the damper 210 may be moved automatically by a power transmission member or transmitter 246 (FIG. 12) and the motor provided in the blower 100 with respect to the first upper body 120 and/or the second upper body 130.

Figure 7:
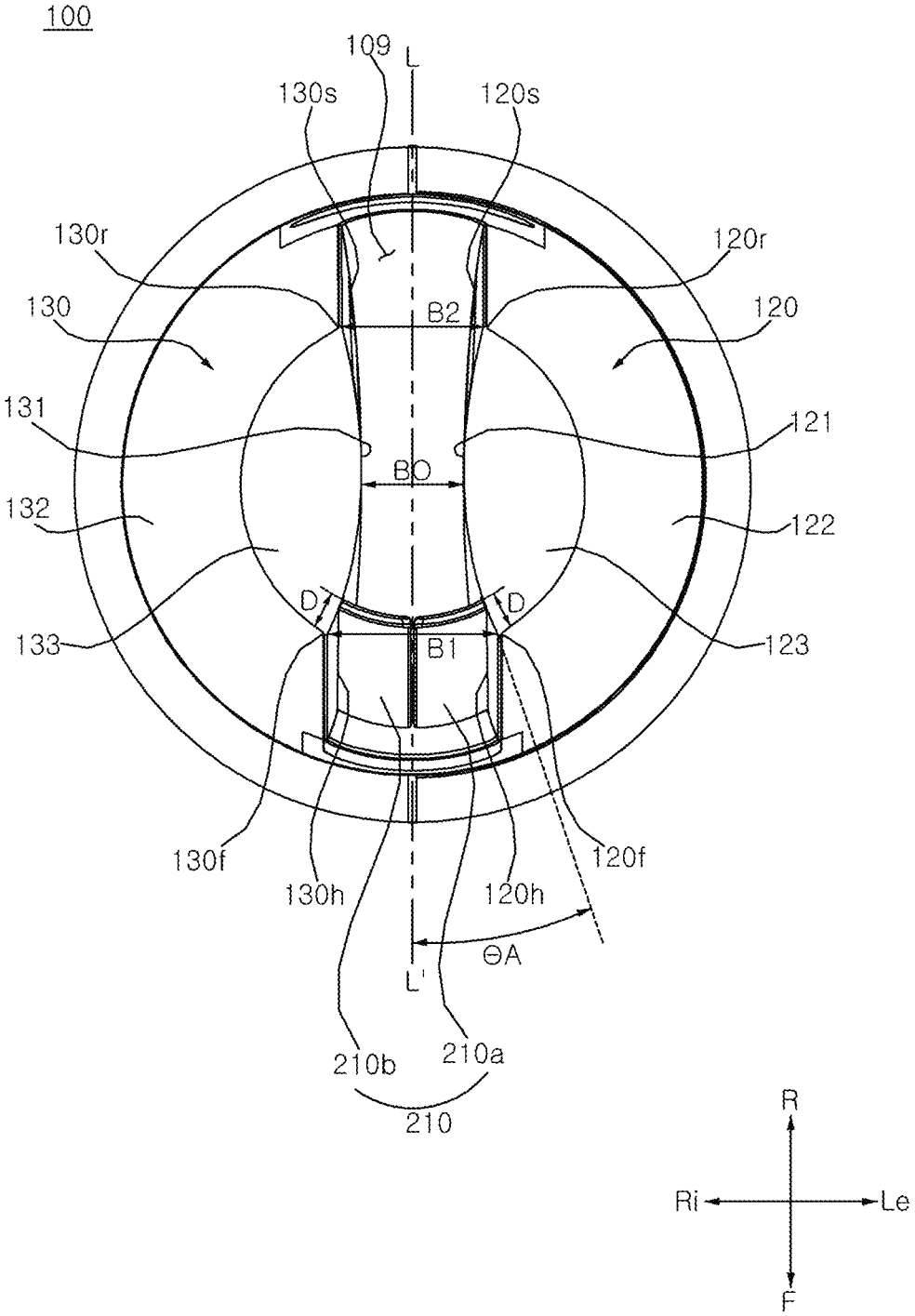
FIG. 7 is a plan view of the blower of FIG. 5.

Referring to FIG. 7, a distance D between the front end 120*f* of the first upper body 120 and the first slot 120*h* may be equal to a distance D between the front end 130*f* of the second upper body 130 and the second slot 130*h*.

The first boundary surface 121 of the first upper body 120 may face the second boundary surface 131 of the second upper body 130 and may form the left and right boundaries of the space 109. The first boundary surface 121 of the first upper body 120 may be convex to the right, and the second boundary surface 131 of the second upper body 130 may be convex to the left. In other words, a gap or distance between the first boundary surface 121 of the first upper body 120 and the second boundary surface 131 of the second upper body 130 may be reduced from the rear toward the front and then may increase again. The gap may be a left-right width of the space 109.

A first or front gap B1 may be defined as a gap between the front end 120*f* of the first upper body 120 and the front end 130*f* of the second upper body 130. A second or rear gap B2 may be defined as a gap between the rear end 120*r* of the first upper body 120 and the rear end 120*r* of the second upper body 130. The second gap B2 may be equal to or different from the first gap B1. A reference or initial gap B0 may be where a distance between the first and second boundary surfaces 121 and 131 is less or at a minimum of the two gaps. As an example, the reference gap B0 may be in a range of 20 mm to 30 mm. The reference gap B0 may also be referred to as a center gap, but the minimum distance between the first and second boundary surfaces 121 and 131 may not necessarily be between exact centers of the first and second boundary surfaces.

As an example, the reference gap B0 may be a distance or gap between the center of the first boundary surface 121 and the center of the second boundary surface 131 of. Alternatively, the reference gap B0 may be a distance a gap between a portion provided in front of the center of the first boundary surface 121 and a portion provided in front of the center of the second boundary surface 131 of the second upper body 130. In yet another example, the reference gap B0 may be a distance or gap between a portion provided behind the center of the first boundary surface 121 of the first upper body 120 and a portion provided behind the center of the second boundary surface 131.

In the illustrated example, a width of a rear portion of the space 109 may be the second gap B2, a width of a center portion of the space 109 may be the reference gap B0, and the width of the space 109 may decrease from the rear toward the center. A width of a front portion of the space 109 may be the first gap B1, and the width of the space 109 may increase from the center toward the front.

A portion of the air circulated by the fan 150 (FIG. 4) may be discharged into the space 109 through the first slit 120*s*, and the rest of the air may be discharged into the space 109 through the second slit 130*s* to be mixed in the space 109. Due to the Coanda effect, air discharged into the space 109 may flow forward along the first boundary surface 121 of the first upper body 120 and the second boundary surface 131 of the second upper body 130.

Figure 8:
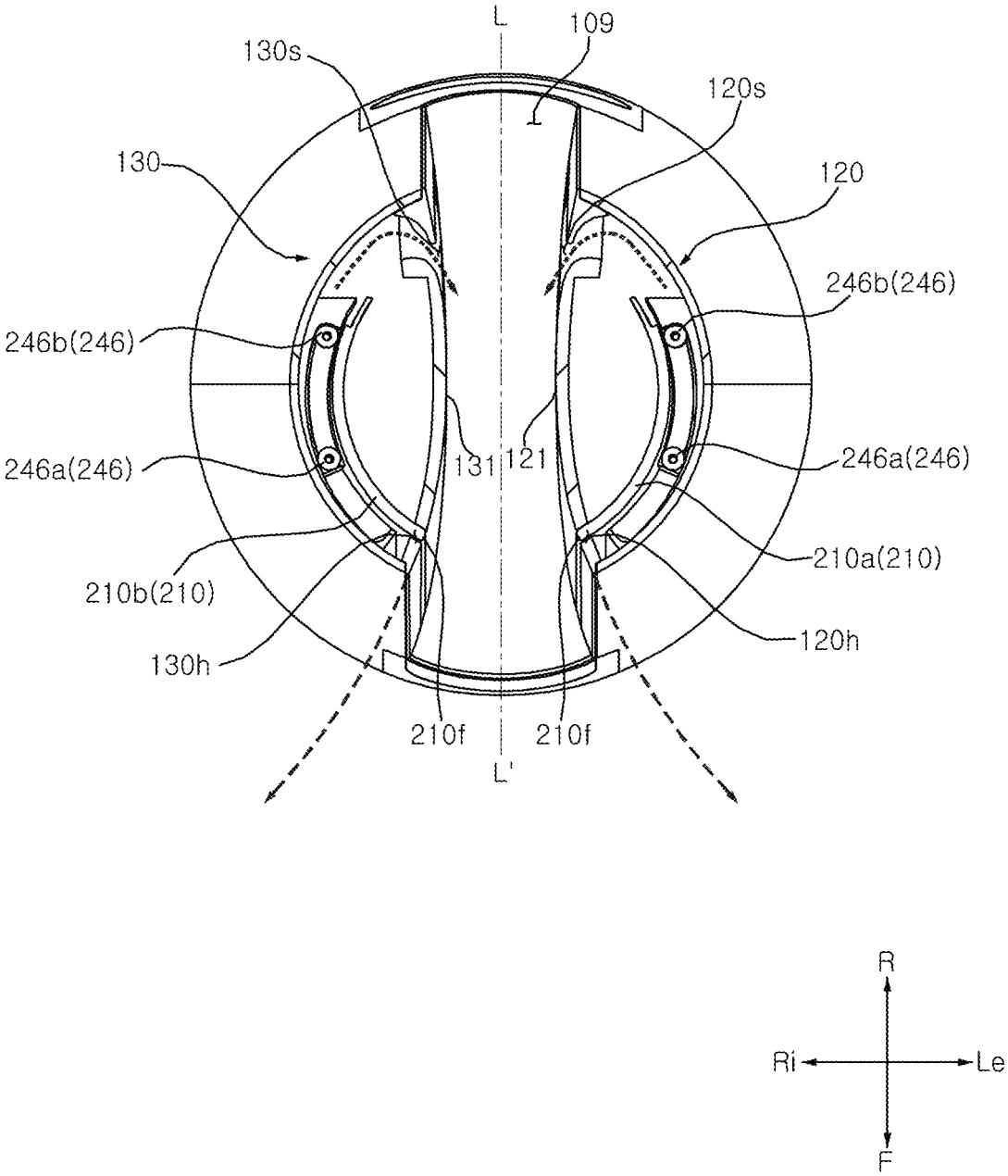
Figure 9:
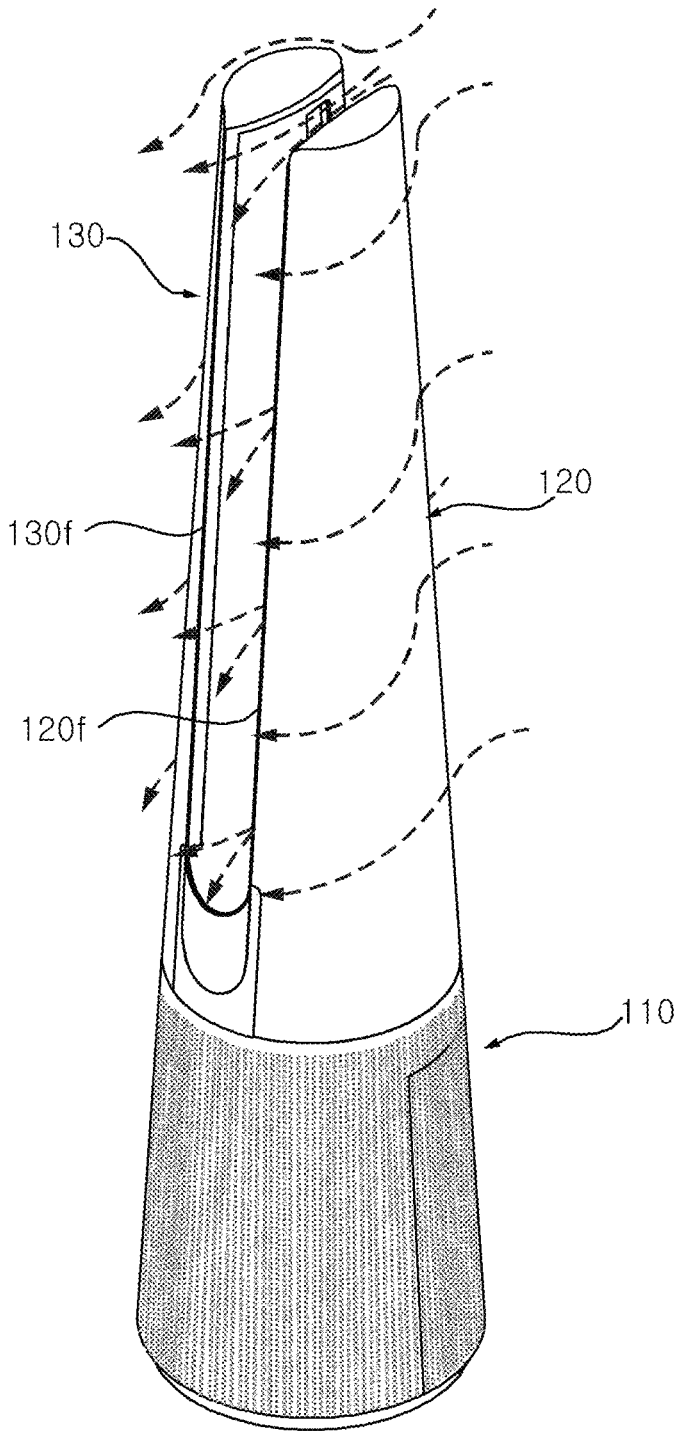

Referring to FIGS. 8 and 9, while the blower 100 is in a first state, the front end 210*f* of the damper 210 may be inserted or hidden in the slots 120*h* and 130*h* to be inside of the first and second upper bodies 120 and 130. In this case, the front end 210*f* of the damper 210 may form a continuous surface with the boundary surfaces 121 and 131.

The air discharged into the space 109 in response to an operation of the fan 150 (FIG. 4) may flow forward along the boundary surfaces 121 and 131 of the upper bodies 120 and 130. The air flowing forward may be distributed to the left and right sides according to a curvature of the boundary surfaces 121 and 131. A flow of the air may form an air current in which air around the upper bodies 120 and 130 may flow into the space 109 or forward along the outer surfaces 122 and 132. The blower 100 may provide sufficient air flow for a user.

Figure 10:
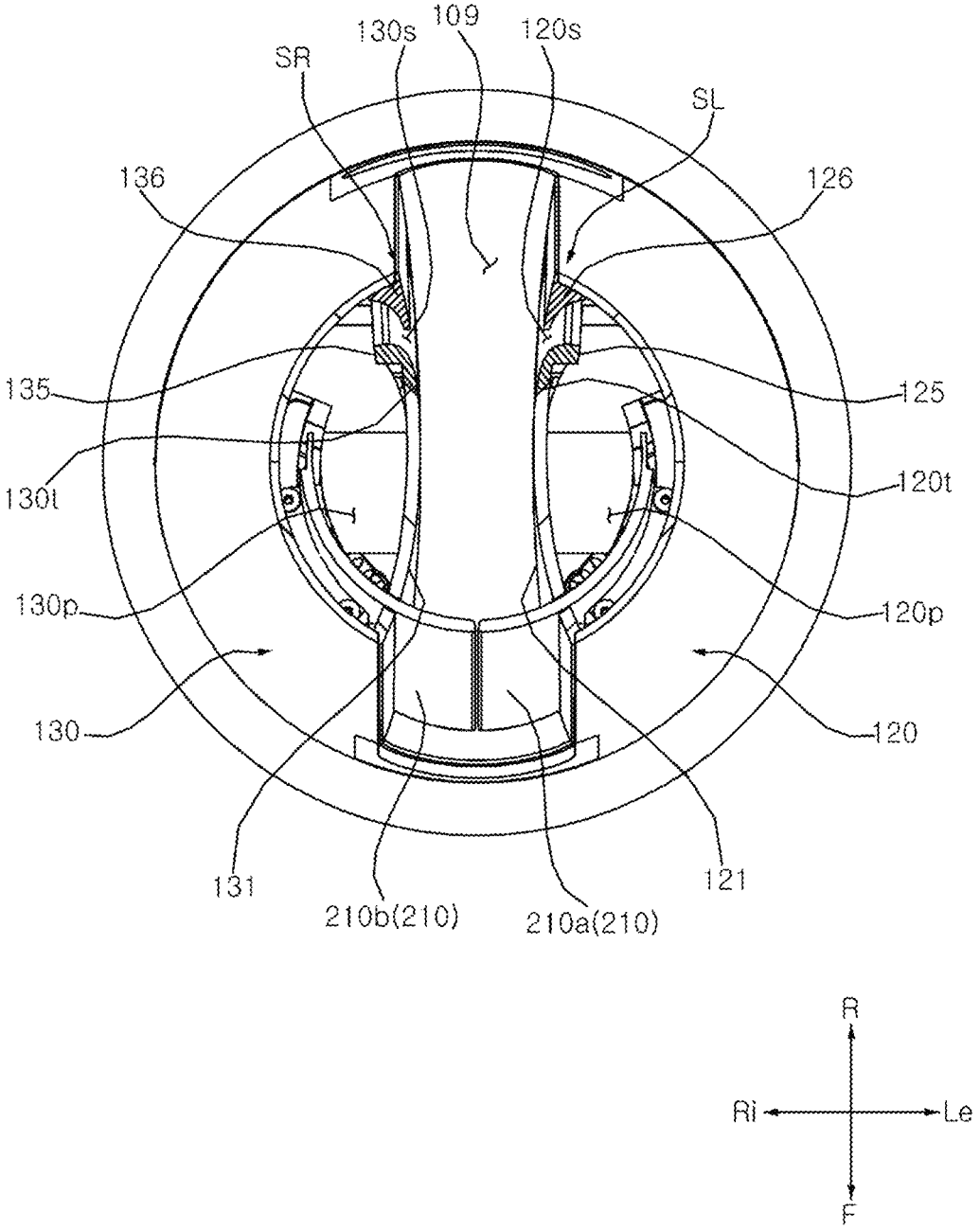
Figure 11:
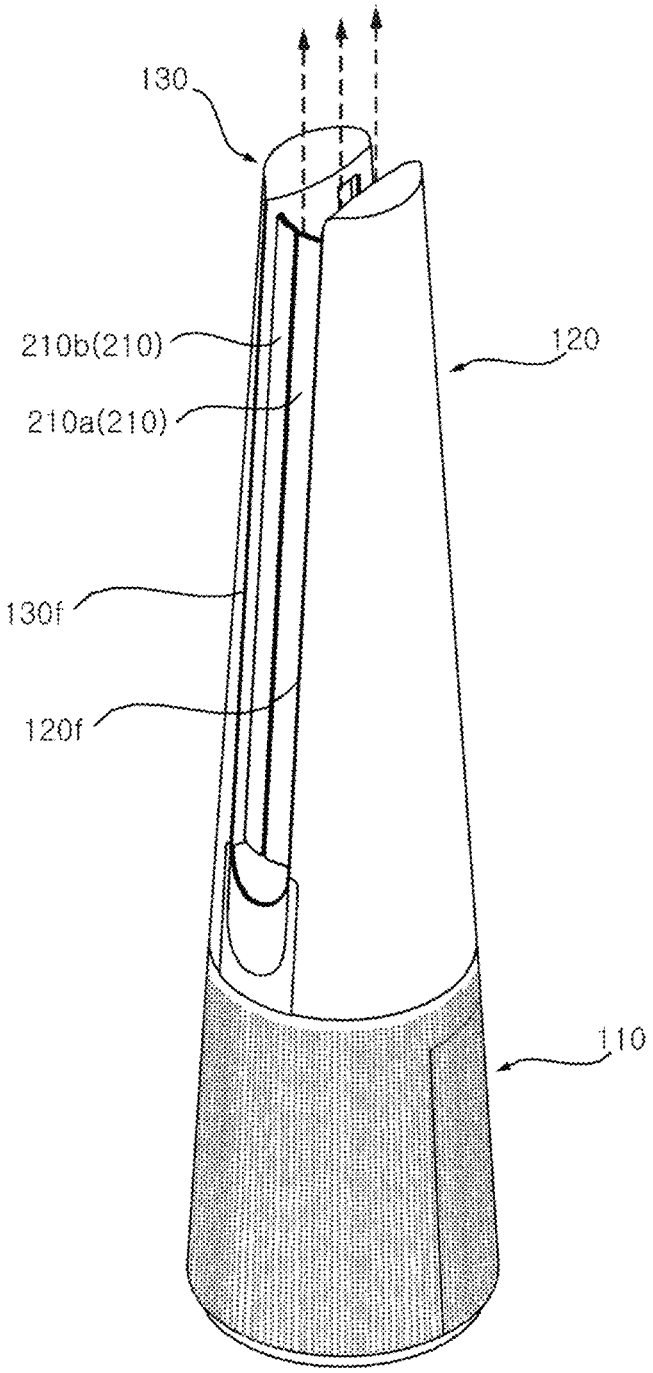

Referring to FIGS. 10 and 11, while the blower 100 is in a second state, a portion of the first damper 210*a* may pass through the first slot 120*h* to be provided and exposed in the space 109, and a portion of the second damper 210*b* may pass through the second slot 130*h* to be provided and exposed in the space 109. The front end 210*f* of the first damper 210*a* and the front end 210*f* of the second damper 210*b* may come into contact with each other.

The air discharged into the space 109 due to the operation of the fan 150 (FIG. 4) may flow forward along the boundary surfaces 121 and 131 of the upper bodies 120 and 130, and then may flow upward upon being blocked by the first damper 210*a* and the second damper 210*b*. By adjusting a position of the front end 210*f* of the damper 210 with respect to a length of the damper 210 protruding from the slot 120*h* or a reference line LL' extending in the front-rear direction, a direction of air discharged from the blower 100 may be adjusted.

Figure 12:
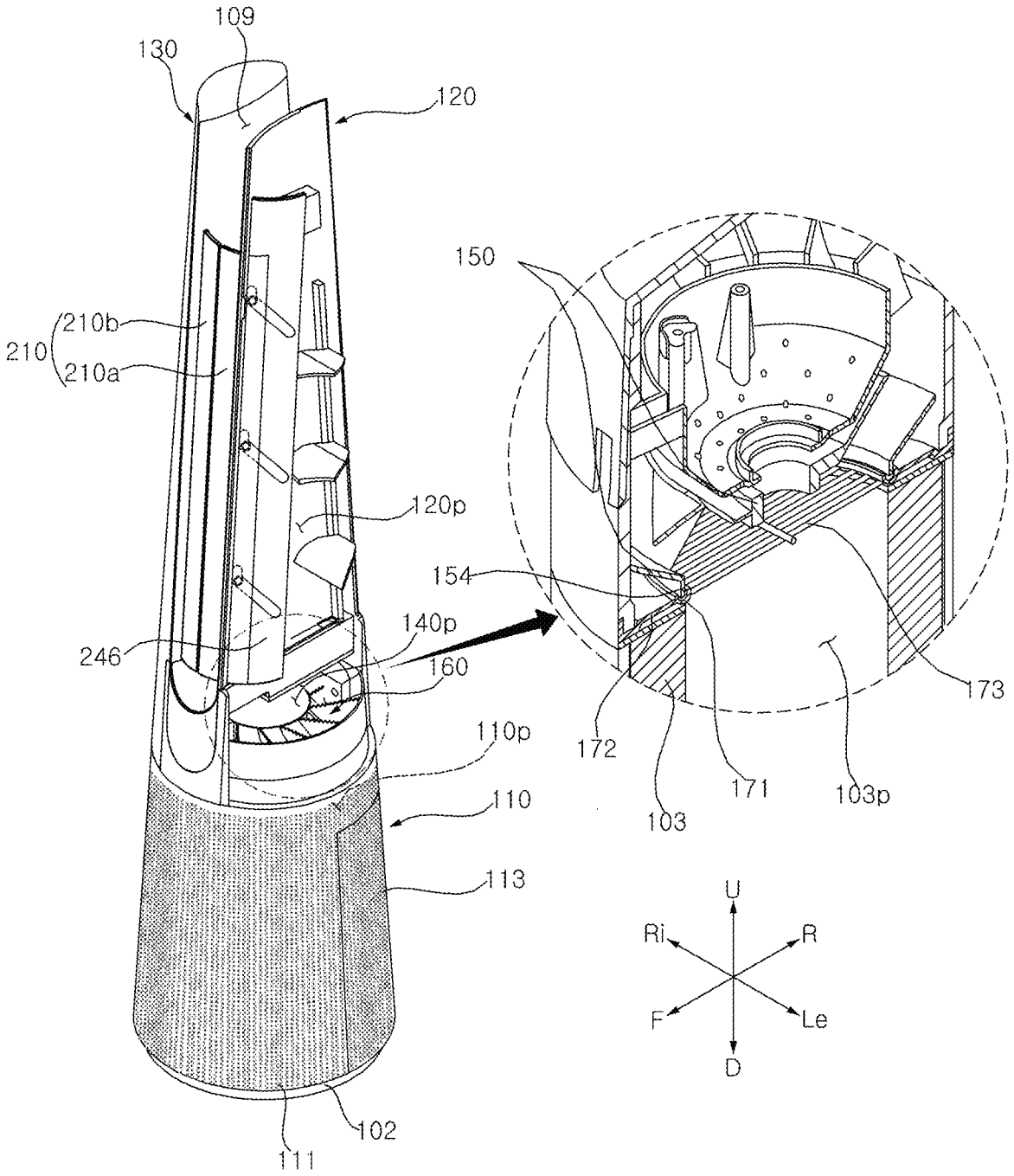
FIG. 12 is a perspective view of a blower from which an outer wall of a first upper body is removed according to an embodiment.

Referring to FIG. 12, a grille 173 may be provided between the filter 103 and the fan 150. The grille 173 may prevent foreign matter from entering the fan 150. When the filter 103 is separated from the lower body 110, the grille 173 may block a user's finger from entering the fan 150.

Figure 13:
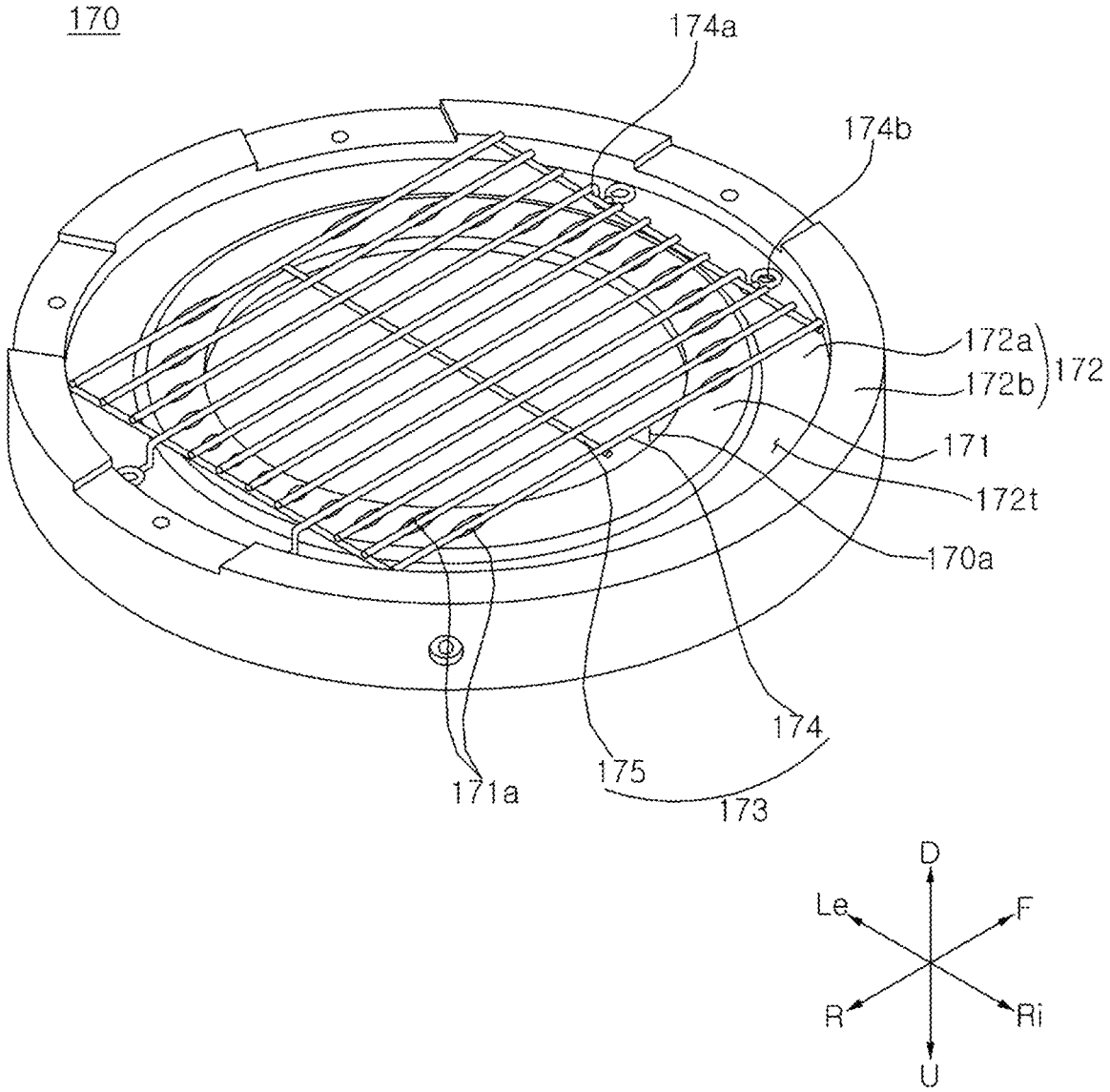
FIG. 13 is a perspective view of a grille assembly according to an embodiment.
Figure 14:
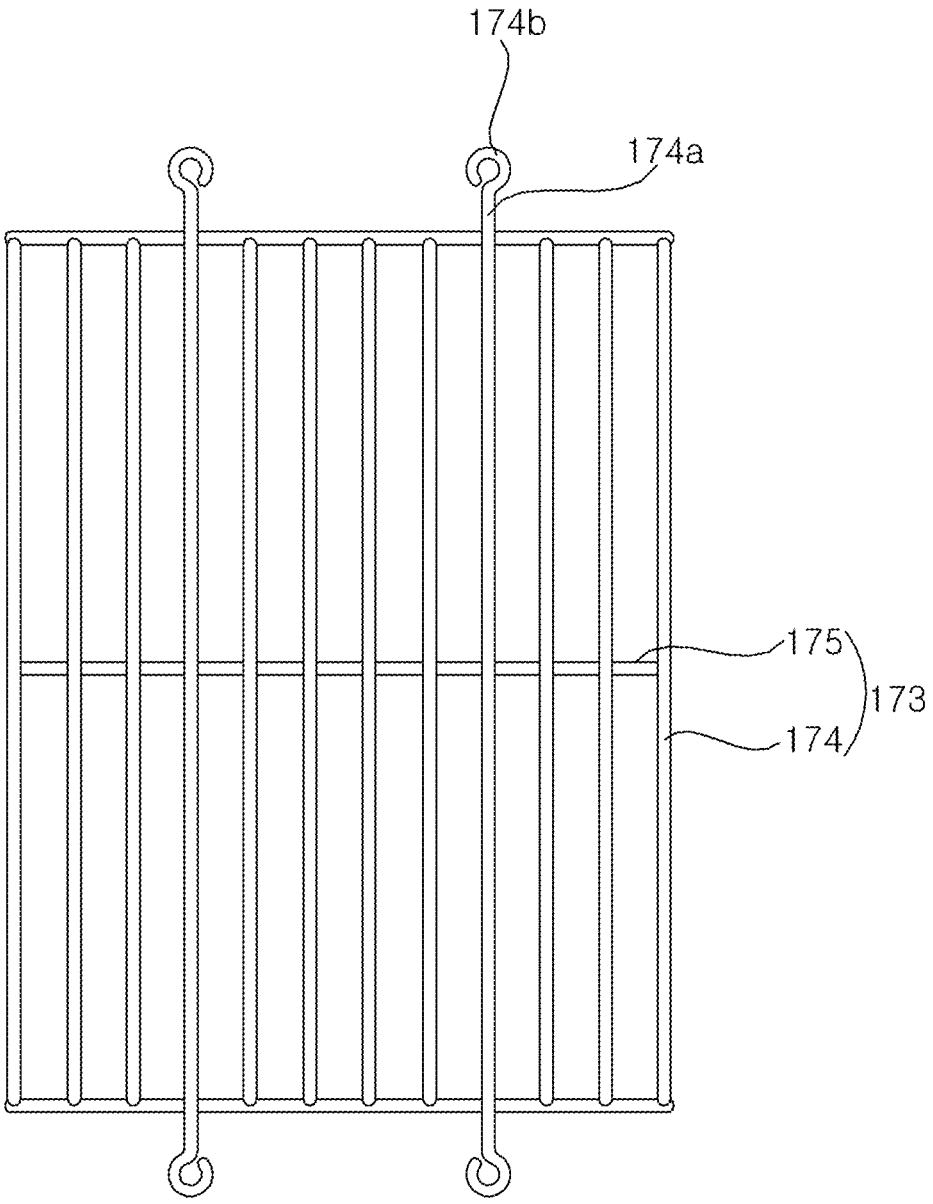
FIG. 14 is a plan view of a grille according to an embodiment.
Figure 15:
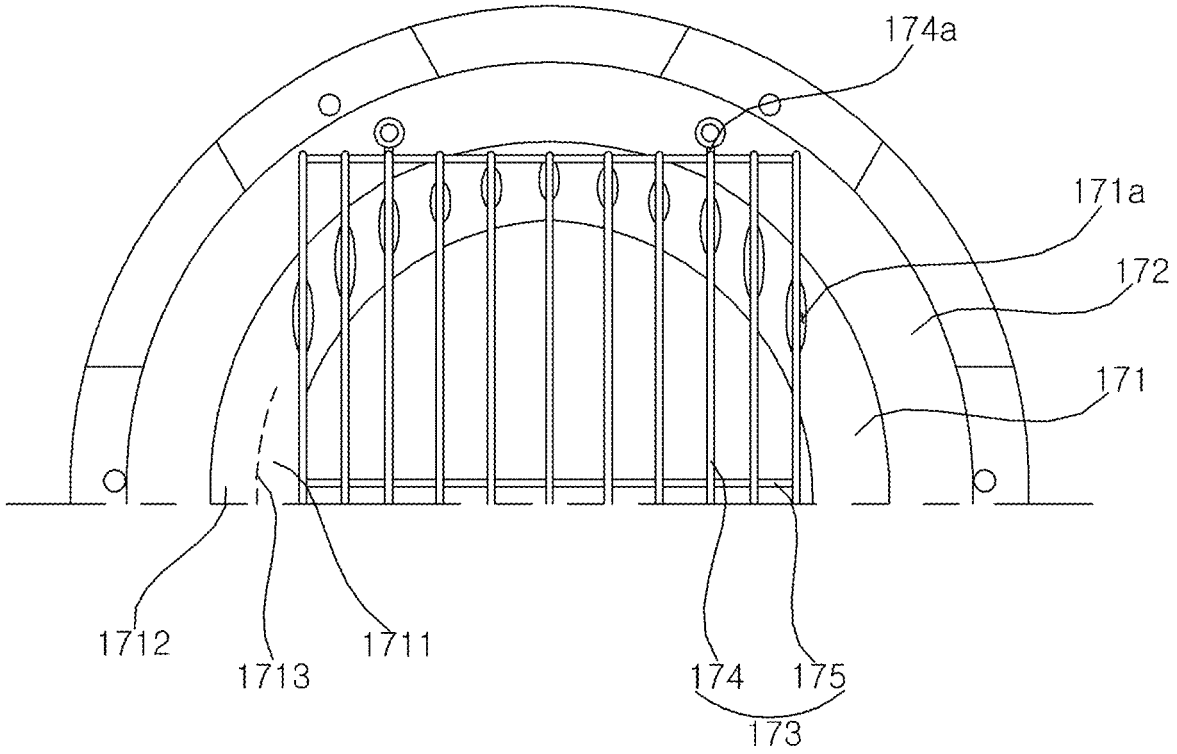
FIG. 15 is a partial plan view of a grille assembly according to an embodiment.

Referring to FIGS. 13 to 15, a grille assembly 170 may include the grille 173, a bell mouth 171, and a support 172. The bell mouth 171 and the support 172 may be formed integrally as one body, or may alternatively be provided separately and later coupled to each other.

The bell mouth 171 may have an overall ring shape. An inlet port 170*a* may be formed on the inside of the bell mouth 171 and may provide air to the fan 150 (see FIG. 12). A diameter and position of the inlet port 170*a* may be configured to decrease from upstream toward downstream with respect to a flow direction of air such that the air may be introduced smoothly into the fan 150 through the inlet port 170*a*. For example, the bell mouth 171 may include plastic or Acrylonitrile Butadiene Styrene resin (ABS) material.

Grooves 171*a* may be recessed from a bottom surface of the bell mouth 171 and may be spaced apart from each other in a circumferential direction. The grooves 171*a* may be elongated in the front-rear direction.

The support 172 may extend in a radial direction of the bell mouth 171 from an outer circumferential surface of the bell mouth 17, to be connected or coupled to an inner circumferential surface of the lower body 110. The support 172 may have an overall ring shape. For example, the support 172 may include a plastic or Acrylonitrile Butadiene Styrene resin (ABS) material.

An inner section or portion 172*a* of the support 172 may form an inner diameter of the supporter 172 and forms a step with respect to the bell mouth 171. An outer section or portion 172*b* of the support 172 may form an outer diameter of the supporter 172 and forms a step with respect to the inner part 172*a*. The inner portion 172*a* may face an upper side of the filter 103. A trap 172*t* may be formed among the bell mouth 171, the inner portion 172*a*, the outer portion 172*b*, and the filter 103. The trap 172*t* may minimize air leakage or escape to the outside through a gap between the grille assembly 170 and the filter 103.

A first coupling groove may be formed at an upper end of the outer portion 172*b*, and the distribution unit 140 may be inserted or coupled to the first coupling groove. A second coupling groove may be formed at a lower end of the outer portion 172*b*, and the lower body 110 may be inserted or coupled to the second coupling groove.

The grille 173 may be coupled to the bell mouth 171 at the bottom of the bell mouth 171. The grille 173 may include a first wire 174 and a second wire 175 which are alternately arranged. The first wire 174 may be elongated in the front-rear direction, and the second wire 175 may be elongated in the left-right direction. The first wires 174 may be spaced apart from each other in the left-right direction, and the second wires 175 may be spaced apart from each other in the front-rear direction. As an example, a number of the first wires 174 may be greater than a number of the second wires 175, but embodiments disclosed herein are not limited. In this case, some of the second wires 175 may be provided at or on both ends of the first wires 174, and the rest of the second wires 175 may be provided in a space between both ends of the first wires 174.

The first wires 174 and the second wires 175 may be coupled to each other by welding, fusion, etc. In this case, the second wires 175 may be coupled or fixed to the first wires 174 at the top of the first wires 174. The grille 173 may include a metal material. Some of the first wires 174 may be inserted into the grooves 171*a*. In this case, a diameter of some of the first wires 174 may be greater than a width of the grooves 171*a*, the first wires 174 may be coupled to the grooves 171*a* by an interference or friction fit. The grooves 171*a* may guide coupling of the first wires 174 to the bell mouth 171.

A leg or hook 174*a* may be formed on some of the first wires 174. The leg 174*a* may be bent toward the inner portion 172*a* from an end of the first wires 174. In this case, a length of the leg 174*a* may be substantially equal to a height of the step of the inner portion 172*a* relative to the bell mouth 171. A ring 174*b* may be formed at the end of the leg 174*a* and may be coupled to the inner portion 172*a*. For example, the ring 174*b* may be hung on a hook provided at a lower portion of the inner portion 172*a*. In another example, a fastening member, such as a screw, may be fastened to a hole formed at the lower portion of the inner portion 172*a* through the ring 174*b*. The hook or the hole may be referred to as a fastening part or member.

The lower end of the grille 173 inserted into the groove 171*a* may be provided at a position higher than, or alternative at a same height as, a lower end 1713 (FIG. 15) of the bell mouth 171. The height of the grille assembly 170 may not be increased due to the grille 173 such that an increase in air flow resistance or noise due to the grille 173 may be reduced or minimized.

Figure 16:
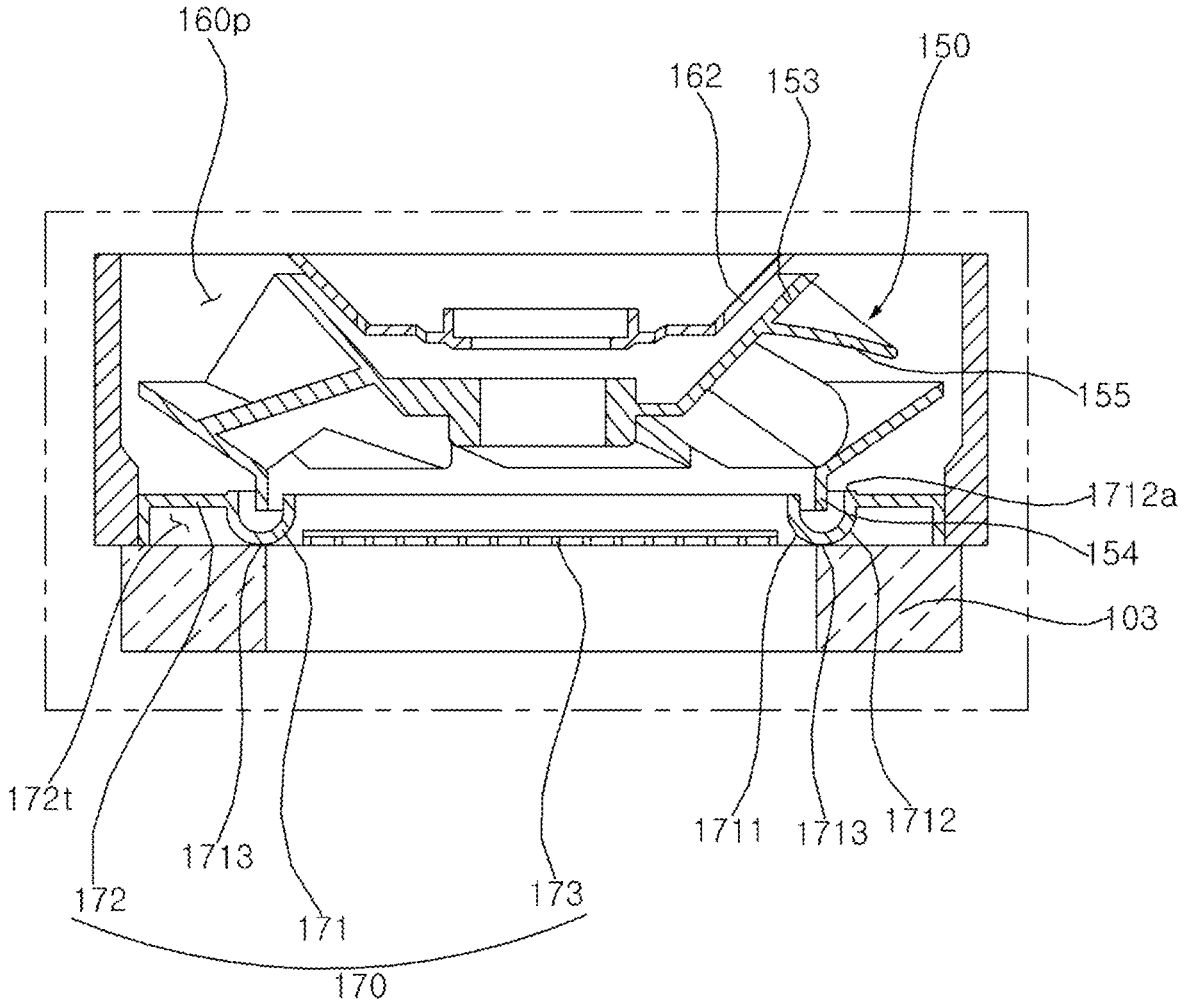
FIG. 16 is a longitudinal cross-sectional view of a grille assembly according to an embodiment.

Referring to FIGS. 15 and 16, the bell mouth 171 may include a first portion or section 1711 and a second portion or section 1712. The first portion 1711 may extend upward from a lower end 1713 of the bell mouth 171 and may form an inner diameter of the bell mouth 171. For example, the first portion 1711 may be convex inwardly of the bell mouth 171. Air introduced into the bell mouth 171 may be provided to the fan 150 along the first portion 1711.

The second portion 1712 may extend upward from the lower end 1713 of the bell mouth 171 and may form an outer diameter of the bell mouth 171. For example, the second portion 1712 may be convex outwardly of the bell mouth 171.

The first portion 1711 and the second portion 1712 may be connected to each other, and the bell mouth 171 may have a U-shaped (or alternatively, V-shaped) cross section. The lower end 1713 of the bell mouth 171 may be provided on an upper surface of the filter 103, and the bell mouth 171 may be convex toward the top surface of the filter 103.

The shroud 154 may form a lower end of the fan 150. A diameter of the shroud 154 may remain constant from a lower end of the shroud 154 up to a predetermined portion or position, and then may increase from the predetermined portion toward an upper end of the shroud.

The lower end of the shroud 154 may be provided between the first portion 1711 and the second portion 1712. In the up-down direction, a position of the lower end of the shroud 154 may be lower than a position of an upper end of the first portion 1711 and an upper end of the second portion 1712. The first portion 1711 and the second portion 1712 may surround the lower end of the shroud 154. Further, the upper end of the first portion 1711 may be provided adjacent to an inside of the lower end of the shroud 154, and the upper end of the second portion 1712 may be provided adjacent to an outside of the lower end of the shroud 154. The first portion 1711, the shroud 154, and the second portion 1712 may form a labyrinth seal, thereby reducing or minimizing scattering of air through a gap between the fan 150 and the bell mouth 171.

A protruding portion 1712*a* may protrude upward from the upper end of the second portion 1712 and may extend in a circumferential direction of the bell mouth 171. The support 172 may be provided below the protruding portion 1712*a*, and the bell mouth 171 may extend in a radial direction of the bell mouth 171 from the side surface of the second portion 1712. The protruding portion 1712*a* may reduce or minimize re-entry of air discharged from the fan 150, improving efficiency or performance of the fan 150.

Figure 17:
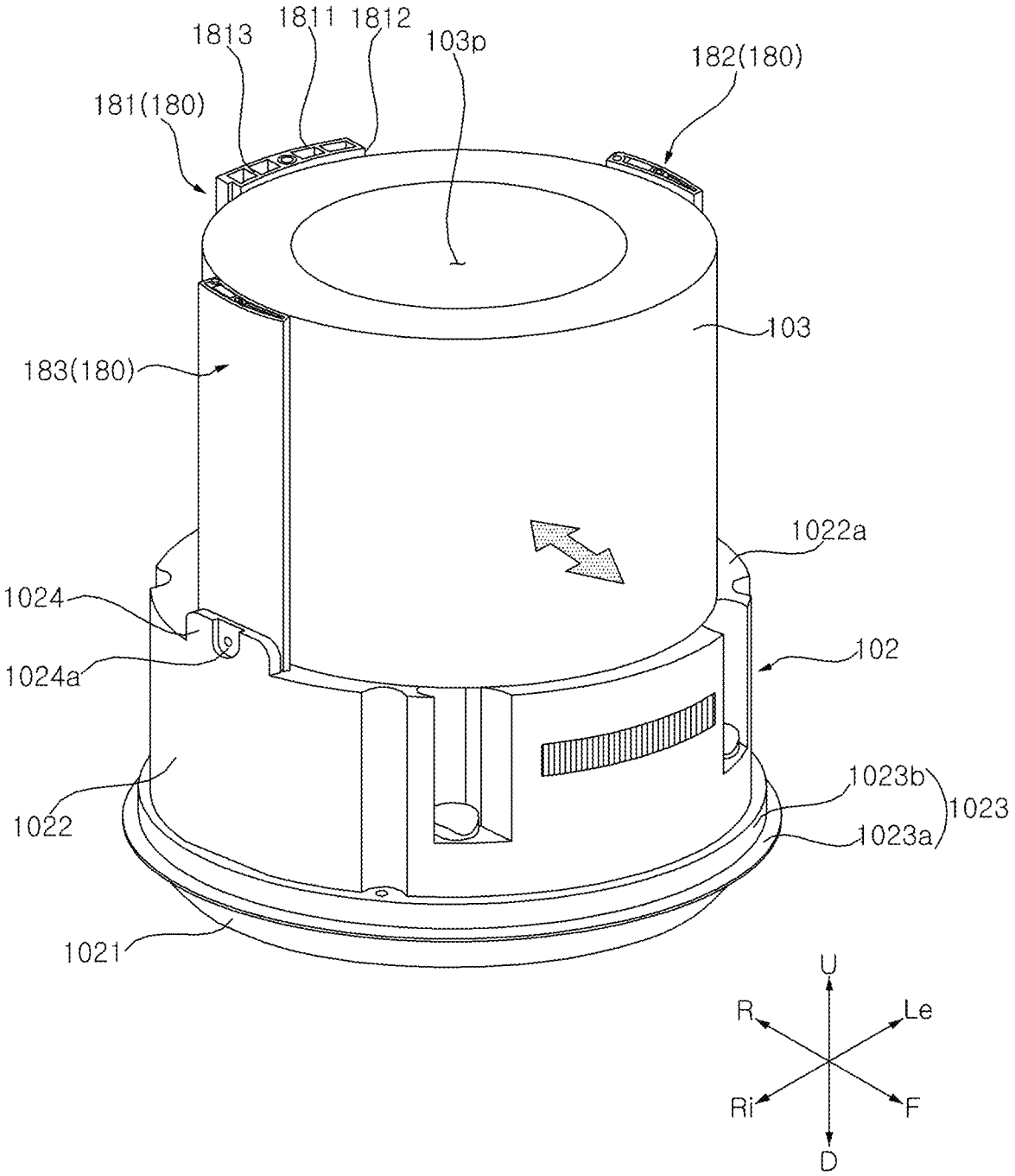
FIG. 17 is a diagram explaining assembly and disassembly of a filter with respect to a base according to an embodiment.

Referring to FIG. 17, the base 102 may include a lower portion or bottom 1021, an upper portion or case 1022, and a middle portion or flange 1023.

The lower portion 1021 may form a bottom surface of the blower 100 and may be placed on a floor, ground, or support surface of a space to be treated (e.g., an indoor space). The lower portion 1021 may have an overall circular plate shape or a disk shape.

The upper portion 1022 may be connected to the lower portion 1021 at the top of the lower portion 1021. For example, the upper portion 1022 and the lower portion 1021 may be integrally formed as one body. Alternatively, the upper portion 1022 and the lower portion 1021 may be manufactured separately and later combined (e.g., fused or fastened). The upper portion 1022 may have an overall cylindrical shape.

The middle portion 1023 may extend in the radial direction of the upper portion 1022 from an outer circumferential surface of the upper portion 1022. The middle portion 1023 may have an overall ring shape. A first middle portion or flange 1023*a* may be provided below a second middle portion or wall 1023*b* and may protrude further than the second middle portion 1023*b* in the radial direction of the upper portion 1022. The lower end of the lower body 110 (FIG. 20) may be seated in the first middle portion 1023*a*, and an inner circumferential surface of the lower body 110 may come into contact with the side surface of the second middle portion 1023*b*. In the up-down direction, an outer diameter of the second middle portion 1023*b* may be substantially equal to an inner diameter of the lower body 110.

When the lower body 110 is coupled to the base 102, the upper portion 1022 and the second middle portion 1023*b* may be hidden from the outside. The lower portion 1021 and the first middle part 1203*a* may be exposed to the outside.

The filter 103 may be provided on an upper surface 1022*a* of the upper portion 1022. A column or pillar 180 may come into contact with or may be coupled to the outside of the filter 103 so as to fix the position of the filter 103 with respect to the upper portion 1022. For example, the column 180 and the upper portion 1022 may be formed integrally as one body. Alternatively, the column 180 and the upper portion 1022 may be separately provided and later coupled to each other via a holder 1024 which will be described later. In yet another example, a portion of the column 180 and the upper portion 1022 may be formed integrally as one body, and the remaining portions of the column 180 may be coupled to the upper portion 1022 via the holder 1024.

The column 180 may be elongated in a longitudinal direction of the filter 103, i.e., in the up-down direction. The column 180 may include a plurality of columns 180 spaced apart from each other in a circumferential direction of the filter 103.

The holder 1024 may be provided on the upper surface 1022*a* of the upper portion 1022. The holder 1024 may extend in a circumferential direction of the upper portion 1022. The holder 1024 may extend along an arc. There may be at least one holder 1024. The holder 1024 may include a plurality of holders 1024 which are spaced apart from each other in the circumferential direction of the upper portion 1022. For example, a number of the holders may be equal to a number of the columns 180. The holder 1024 may be aligned with the column 180 in a radial direction of the upper portion 1022 or in a radial direction of the filter 103.

The holder 1024 may protrude upward from the upper surface 1022*a* of the upper portion 1022 and may face an outer lower part of the column 180. A holder hole 1024*a* may penetrate through the holder 1024. A fastening member, such as a screw, may be fastened to the column 180 by passing through the holder hole 1024*a* such that the column 180 may be fixed to the surface of the base 102. An outer circumferential surface of the holder 1024 may be smoothly connected to the outer circumferential surface of the upper portion 1022.

In another example, the holder 1024 may be recessed from the upper surface 1022*a* of the upper portion 1022, and a lower portion of the column 180 may be inserted into the holder 1024. An upper hole may penetrate the upper portion 1022. A fastening member, such as a screw, may be fastened to the column 180 by passing through the upper hole such that the column 180 may be fixed to the base 102.

Figure 18:
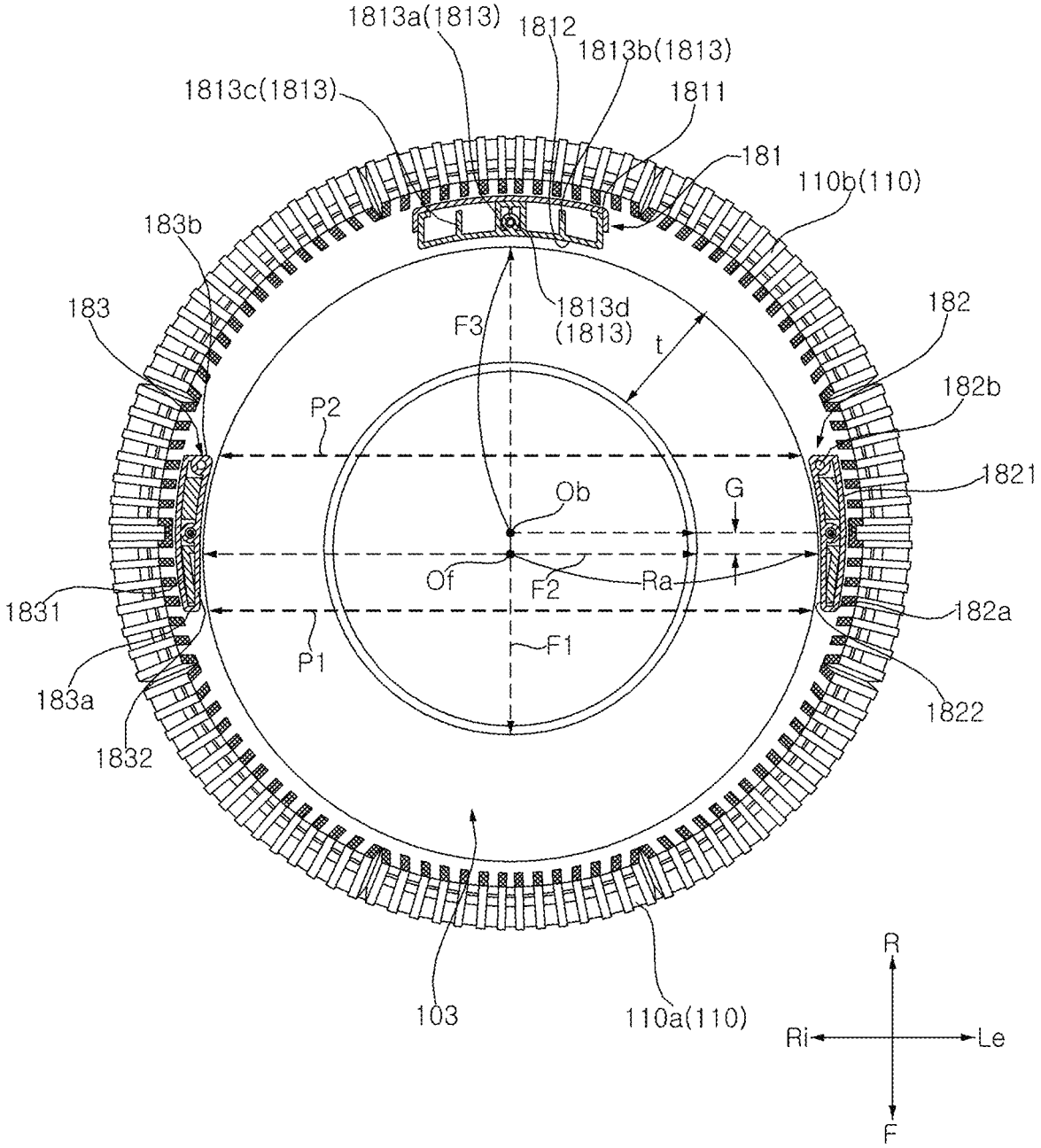
FIG. 18 is a transverse cross-sectional view of a filter, a column, and a lower body according to an embodiment.

Referring to FIGS. 17 and 18, the columns 180 and at least one holder 1024 may be provided outside of a path of the filter 103 inserted into or separated from the base 102. The filter 103 may be mounted on the base 102 by being moved rearward from the top of the base 102 and may be separated from the base 102 by being moved forward. Portions of the columns 180 coming into contact with the filter 103 may be provided at an angle in a range of 180 degrees in the circumferential direction. For example, the columns 180 may be provided at left, right, and rear sides of the filter 103.

A first column 181 may be provided at a rear portion of the upper surface 1022*a* of the upper body 1022. The holder 1024 may be provided at the rear portion of the upper surface of the upper body 1022 to be coupled to the first column 181. The first column 181 may be provided at the rear side of the filter 103 and may be fixed to the top of the base 102 via the holder 1024. The first column 181 may extend along an outer circumferential surface of the filter 103. The first column 181 may include a first outer wall 1811 and a first inner wall 1812.

The first outer wall 1811 and the first inner wall 1812 may extend along an arc. The first outer wall 1811 may be coupled to the first inner wall 1812 at a rear side of the first inner wall 1812. The first outer wall 1811 may be adjacent to or come into contact with the inner circumferential surface of the lower body 110. A curvature of the first outer wall 1811 may be substantially equal to a curvature of the inner circumferential surface of the lower body 110. The first inner wall 1812 may be concave toward the filter 103 and may come into contact with the outer circumferential surface of the filter 103. A curvature of the first inner wall 1812 may be substantially equal to a curvature of the outer circumferential surface of the filter 103.

The second column 182 may be provided at a left portion of the upper surface 1022*a* of the upper body 1022. The holder 1024 may be provided at the left portion of the upper surface of the upper body 1022 to be coupled to a second column 182. The second column 182 may be provided at the left side of the filter 103 and may be fixed to the top of the base 102 via the holder 1024. The second column 182 may extend along the outer circumferential surface of the filter 103. The second column 182 may include a second outer wall 1821 and a second inner wall 1822.

The second outer wall 1821 may be coupled to the second inner wall 1822 at a left side of the second inner wall 1822. The second outer wall 1821 may be adjacent to or come into contact with the inner circumferential surface of the lower body 110. A curvature of the second outer wall 1821 may be substantially equal to a curvature of the inner circumferential surface of the lower body 110. The second inner wall 1822 may be concave toward the filter 103, and a portion of the second wall 1822 may come into contact with the outer circumferential surface of the filter 103. A curvature of the portion of the second inner wall 1822 may be substantially equal to a curvature of the outer circumferential surface of the filter 103.

A third column 183 may be provided at a right side of the upper surface 1022*a* of the upper body 1022. The holder 1024 may be provided at the right side of the upper surface of the upper body 1022 to be coupled to the third column 183. The third column 183 may be provided at the right side of the filter 103 and may be fixed to the top of the base 102 via the holder 1024. The third column 183 may extend along an outer circumferential surface of the filter 103. The third column 183 may include a third outer wall 1831 and a third inner wall 1832.

The third outer wall 1831 may be coupled to the third inner wall 1832 on a right side of the third inner wall 1832. The third outer wall 1831 may be directed toward the lower body 110, and may be adjacent to or come into contact with the inner circumferential surface of the lower body 110. A curvature of the third outer wall 1831 may be substantially equal to a curvature of the inner circumferential surface of the lower body 110. The third inner wall 1832 may be directed toward the filter 103, and a portion of the third inner wall 1832 may come into contact with the outer circumferential surface of the filter 103. A curvature of the portion of the third inner wall 1832 may be substantially equal to a curvature of the outer circumferential surface of the filter 103.

The filter 103 may be mounted on the base 102 by being moved rearward between the second column 182 and the third column 183. The first column 181, the second column 182, and the third column 183 may support an outer circumferential surface of the filter 103. The column 180 may reduce or minimize vibrations of the filter 103 due to vibrations caused by the fan 150 (FIG. 16). The column 180 may reduce or minimize displacement of the filter 103 with respect to the base 102, thereby reducing or minimizing an increase in flow resistance of air passing through the filter 103 and reducing a reduction in filter efficiency.

A controller may be provided in an inner space of the upper portion 1022. The controller may be electrically connected to components of the blower 100 to control operations of the blower 100. A cable may be connected to the electronic components of the blower 100 to provide power or signals thereto.

The cable may be provided in the column 180 to prevent interference between the cable and the filter 103. Such a configuration may prevent damage caused by contact between the filter 103 and the cable during assembly or disassembly of the filter 103 to and from the base 102. Further, the filter 103 may be prevented from deviating from an initial or normal position with respect to the base 102 due to the cable. For example, the cable may be provided inside the first column 181.

A first partition wall 1813 may be provided between the first outer wall 1811 and the first inner wall 1812. The first partition wall 1813 may extend toward the first outer wall 1811 from the inside of the first inner wall 1812. The first partition wall 1813 may divide a space between the first outer wall 1811 and the first inner wall 1812 into two or more sub-spaces. The space may be elongated in a longitudinal direction of the first column 181.

For example, the first partition wall 1813 may include a first middle partition wall 1813*a*, a first left partition wall 1813*b*, and a first right partition wall 1813*c*. The first middle partition wall 1813*a* may be provided at a center of the first column 181. The first left partition wall 1813*b* may be provided between the first middle partition wall 1813*a* and a left edge of the first column 181. The first right partition wall 1813*c* may be provided between the first middle partition wall 1813*a* and a right edge of the first column 181.

The first middle partition wall 1813*a*, the first left partition wall 1813*b*, and the first right partition wall 1813*c* may divide a space between the first outer wall 1811 and the first inner wall 1812 into four sub-spaces. As an example, a power cable may be provided in two of the four sub-spaces, and a signal cable may be provided in the remaining two sub-spaces.

The first middle partition wall 1813*a* may extend toward the first outer wall 1811 from an inside of the first inner wall 1812 to come into contact with the inside of the first outer wall 1811. The first left partition wall 1813*b* may extend toward the first outer wall 1811 from the inside of the first inner wall 1812 and may be spaced apart from the inside of the first outer wall 1811. The first right partition wall 1813*c* may extend toward the first outer wall 1811 from the inside of the first inner wall 1812 and may be spaced apart from the inside of the first outer wall 1811.

A thickness of the first middle partition wall 1813*a* may be greater than a thickness of the first left partition wall 1813*b* and a thickness of the first right partition wall 1813*c*. A boss 1813*d* may be provided inside the first middle partition wall 1813*a* to guide coupling of the first outer wall 1811 and the first inner wall 1812.

Figure 19:
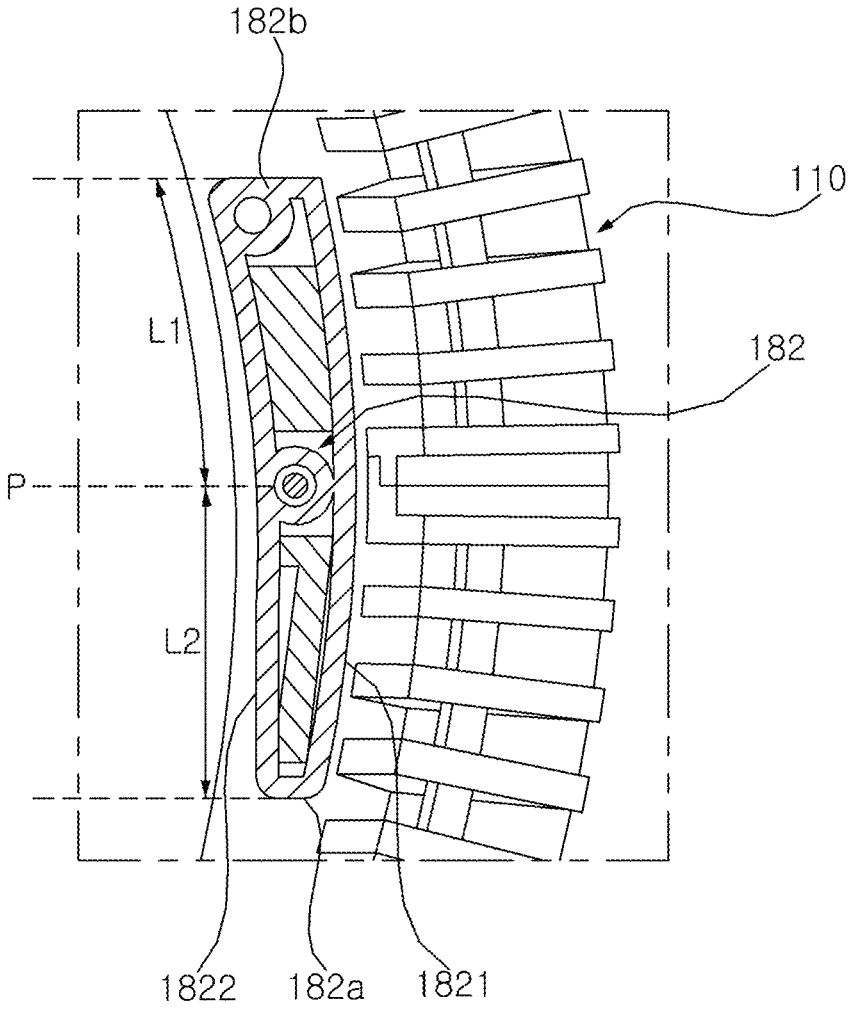
FIG. 19 is an enlarged view of a second column according to an embodiment.

Referring to FIGS. 18 and 19, a portion of a second inner wall 1822 of the second column 182 may come into contact with the outer circumferential surface of the filter 103, and the other portions thereof may be spaced apart from the filter 103. A support section L1, formed as a portion of the second inner wall 1822 may extend along an arc. The support section L1 may be connected to a rear end 182*b* of the second column 182 and may come into contact with the outer circumferential surface of the filter 103. A curvature of the support section L1 may be substantially equal to a curvature of the outer circumferential surface of the filter 103.

An entry section L2, which may be a remaining portion of the second inner wall 1822, may extend in a straight line. The entry section L2 may be connected to the front end 182*a* of the second column 182 and may be spaced apart from the outer circumferential surface of the filter 103. The entry section L2 may be provided in front of the support section L1.

A thickness of the second column 182 at a position of the support section L1 may be greater than a thickness of the second column 182 at a position of the entry section L2. A thickness of the rear end 182*b* of the second column 182 may be two times or more greater than a thickness of the front end 182*a* of the second column 182. For example, the thickness of the rear end 182*b* of the second column 182 may be 10 mm, and the thickness of the front end 182*a* of the second column 182 may be 4 mm. The filter 104 may easily enter the entry section L2.

The third column 183 and the second column 182 may be bilaterally symmetrical to each other. The second column 182 and the third column 183 may have an overall wedge shape. A gap or distance between the entry section L2 of the second column 182 and an entry section of the third column 183 may increase from a rear toward a front. In another example, a gap or distance between the entry section L2 of the second column 182 and the entry section of the third column 183 may remain constant.

An imaginary straight line P which extends along a boundary of the entry section L2 and the support section L1 may intersect a first central axis Ob. The straight line P may be perpendicular to the first central axis Ob. The first central axis Ob may be aligned coaxially with a longitudinal axis of the base 102 and a longitudinal axis of the lower body 110. The first central axis Ob may be coaxial with a rotational central axis of the fan 150.

A first gap or distance P1 between a front end 182*a* of the second column 182 and a front end 183*a* of the third column 183 may be greater than a second gap P2 between a rear end 182*b* of the second column 182 and a rear end 183*b* of the third column 183. The first gap P1 may be greater than or equal to an outer diameter of the filter 103. The second gap P2 may be smaller than the outer diameter of the filter 103.

An inner radius F1 of the filter 103 may be a distance from a second central axis Of to an inner surface of the filter 103. An outer radius F2 of the filter 103 may be a distance from the second central axis Of to an outer surface of the filter 103. The second central axis Of may be a longitudinal axis of the filter 103. A thickness t of the filter 103 may be a value obtained by subtracting the inner radius F1 from the outer radius F2. The second column 182 and the third column 183 may be bilaterally symmetrical with respect to an imaginary line intersecting the first central axis Ob and the second central axis Of and extending in the front-rear direction.

Figure 20:
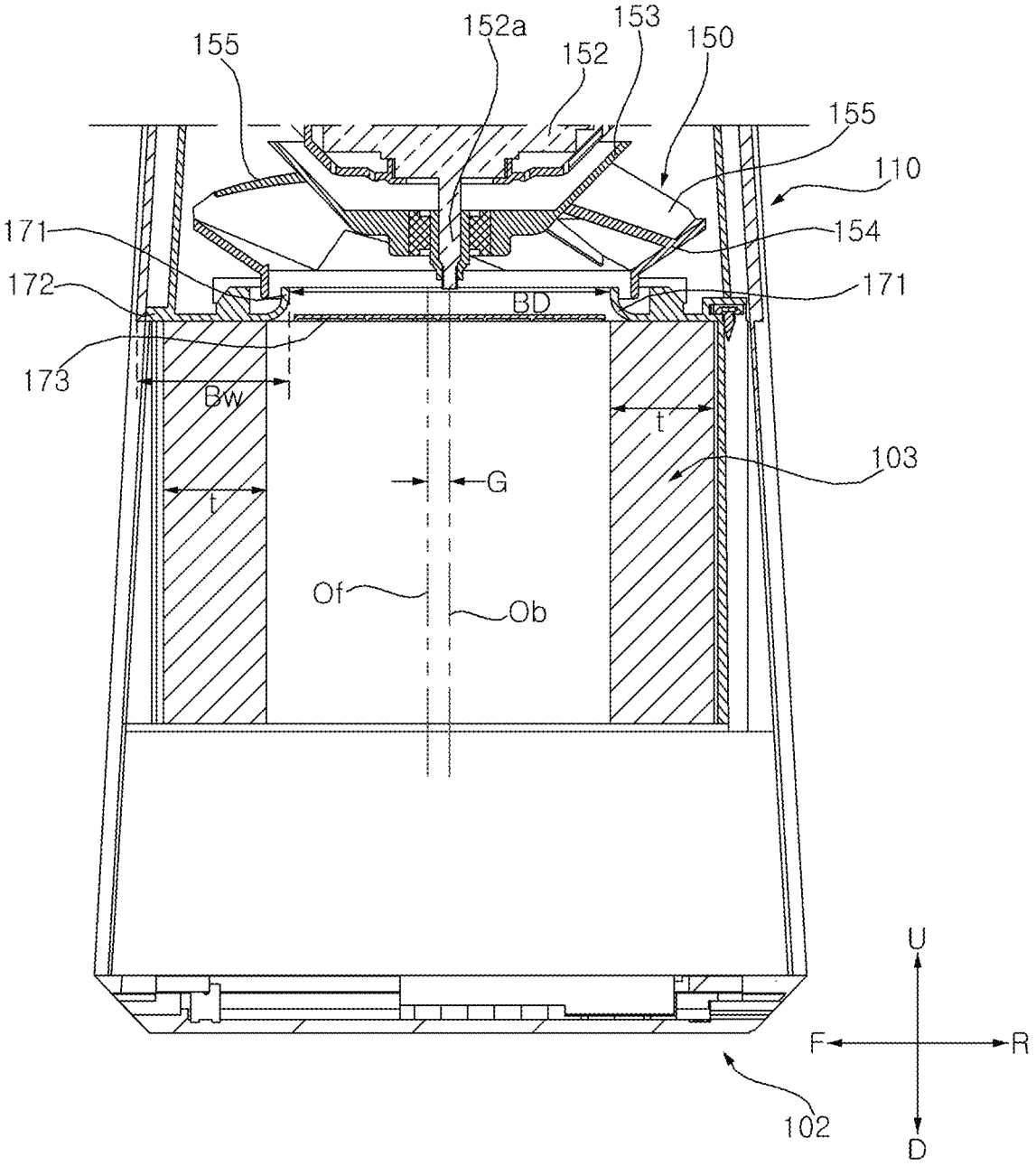
FIG. 20 is a side cross-sectional view of a blower having a filter according to an embodiment.
Figure 21:
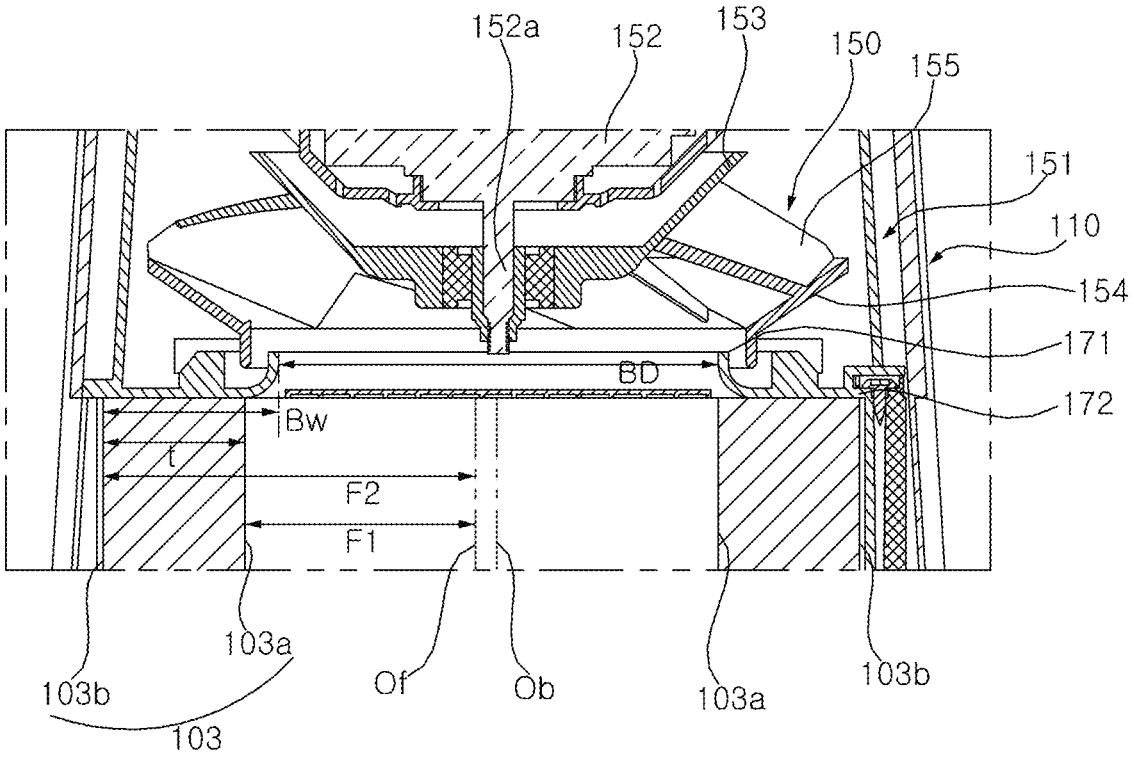
FIG. 21 is an enlarged view of a portion of FIG. 20.
Figure 22:
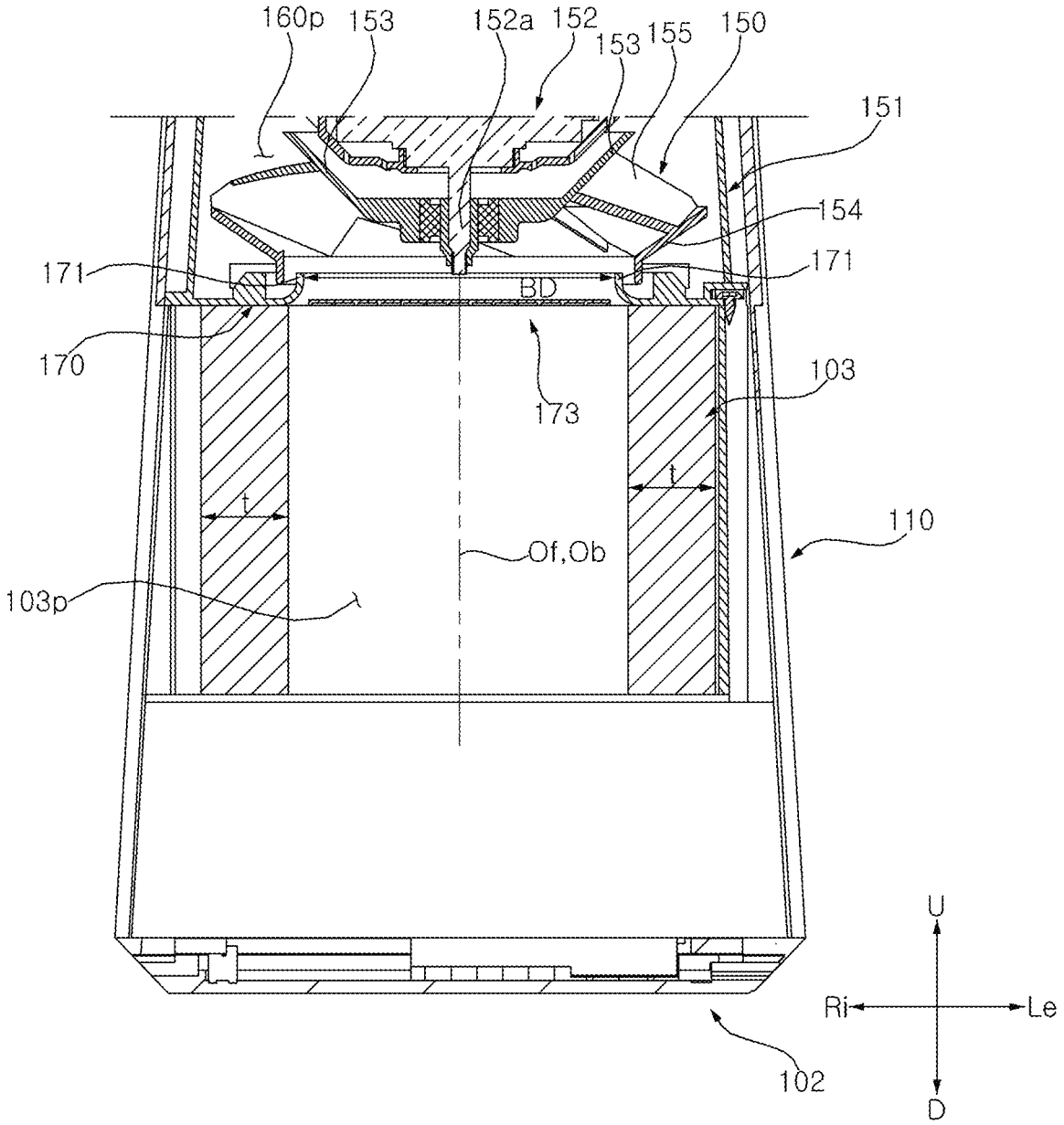
FIG. 22 is a front cross-sectional view of a blower having a filter according to an embodiment.

Referring to FIGS. 20 to 22, the first central axis Ob and the second central axis Of may be spaced apart from each other. The second central axis Of may be aligned with the first central axis Ob in the front-rear direction, and may be provided in front of the first central axis Ob. The second central axis Of may be biased or shifted forward with respect to the first central axis Ob to prevent interference caused by the column 180 during assembly and disassembly of the filter 103 to and from the base 102. A front-and-rear width of the filter 103 may be greater than a left-and-right width of the filter 103.

In the front-rear direction, a gap or distance G between the first central axis Ob and the second central axis Of may be in a range of 3 mm to 7 mm. If the gap G is less than 3 mm, a diameter of the filter 103 may be small and difficult to increase. If the gap G exceeds 7 mm, the filter 103 may not occupy a sufficient inner space of the lower body 110.

Alternatively, the gap G may be in a range of 1.5% to 3.5% of the outer diameter of the filter 103 (e.g., two times the outer radius F2). If the gap G is less than 1.5% of the outer diameter of the filter 103, increasing the diameter of the filter 103 may be difficult. If the gap exceeds 3.5% of the outer diameter of the filter 103, the filter 103 may not occupy a sufficient inner space of the lower body 110.

Figure 23:
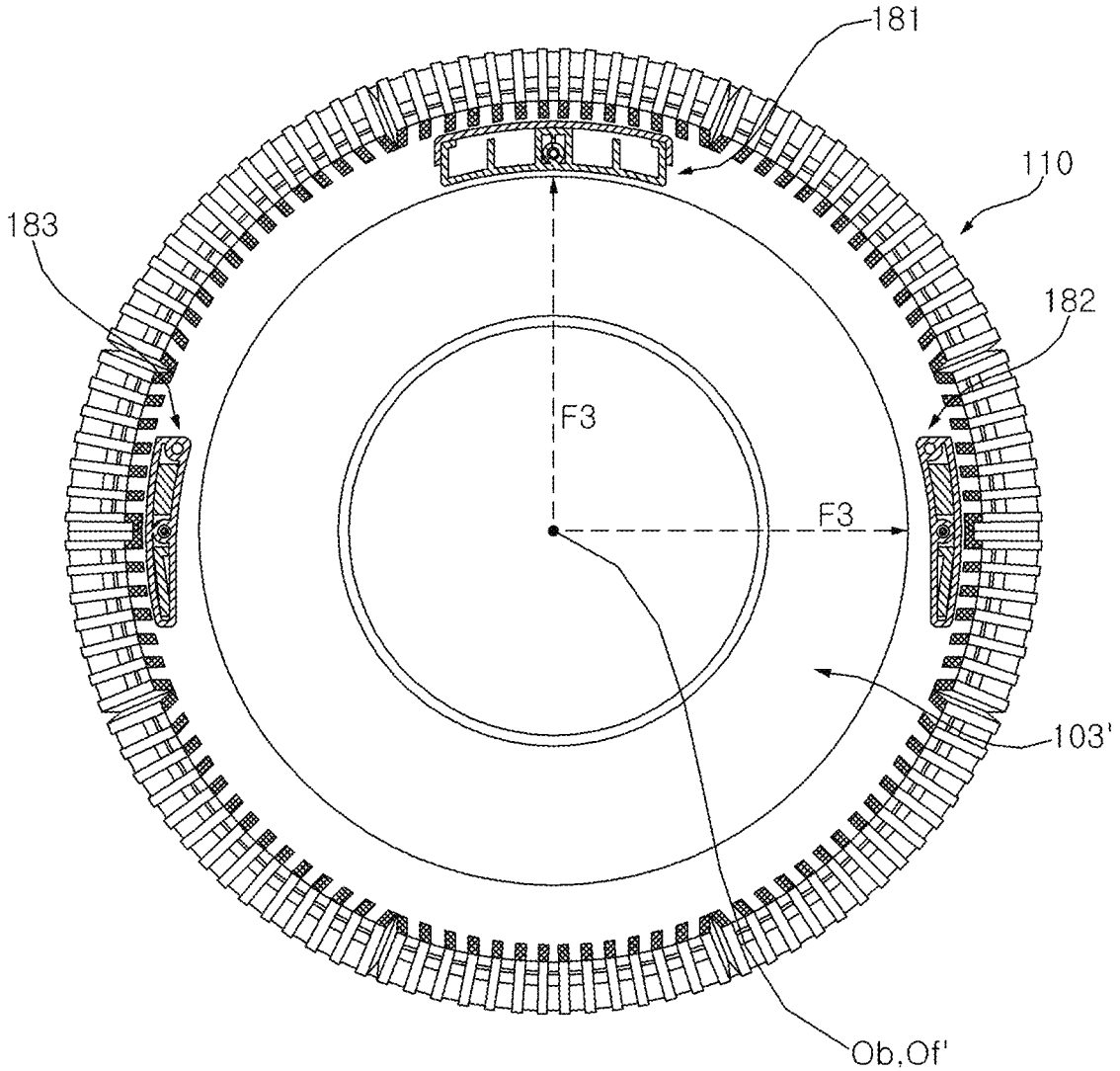
FIG. 23 is a diagram for comparison with the present disclosure.

Referring to FIGS. 18 and 23, as the second central axis Of is biased forward with respect to the first central axis Ob, a volume of the filter 103 may be increased or maximized. A distance between the first central axis Ob and the first inner wall 1812 of the first column 180 may be F3.

FIG. 23 is to exemplify a comparison in terms of an alignment of the filter 103. Referring to FIG. 23, a second central axis Of', which may be a longitudinal axis of a filter 103', may be coaxial with the first central axis Ob. A filter 103' may be supported by the first column 181. An outer radius of the filter 103' may be equal to F3. For example, the outer diameter of the filter 103' may be 190 mm. Here, as compared to FIG. 18, the filter 103' may not be biased with respect to the a longitudinal axis of the lower body 110.

Referring back to FIG. 18, the second central axis Of may be biased forward with respect to the first central axis Ob, and the filter 103 may be supported by the first column 181, the second column 182, and the third column 183. In addition, the outer radius of the filter 103 may be F2 which is greater than F3. A difference between F2 and F3 may be equal to the gap G between the second central axis Of and the first central axis Ob. For example, the gap G may be 5 mm, and the outer diameter of the filter 103 may be 200 mm. The outer diameter of the filter 103 and the thickness of the filter 103 may be increased, thereby improving filter efficiency.

Referring back to FIGS. 20 and 21, the bell mouth 171 may be provided above the filter 103. Air introduced into the lower body 110 may be purified by flowing from the outer circumferential surface 103*b* of the filter 103 to the inner circumferential surface 103*a* thereof, and may pass through the hole 103*p* to flow into the inlet port 170*a* (FIG. 13) of the bell mouth 171.

An inner end of the bell mouth 171 may form a boundary of the inlet port 170*a* and may be an end of the first portion 1711 (FIG. 16) of the bell mouth 171. A diameter BD of the inlet port 170*a* may be smaller than the inner diameter (e.g., two times the inner radius F1) of the filter 103. A half of a difference between the diameter BD of the inlet port 170*a* and the inner diameter of the filter 103 may be greater than the gap G between the second central axis Of and the first central axis Ob. The inlet port 170*a* of the bell mouth 171 may be provided above the hole 103*p* of the filter 103.

In the up-down direction, all regions of the inlet port 170*a* may overlap or be aligned with the hole 103*p*. Even when the second central axis Of is biased forward with respect to the first central axis Ob, an entire region of the inlet port 170*a* may be provided above the hole 103*p* such that flow resistance of air flowing from the filter 103 toward the fan 150 may be reduced or minimized.

A distance between an inner end of the bell mouth 171 and an outer end of the supporter 172 may be a width Bw of the grille assembly 170 (FIG. 13). Here, the outer end of the supporter 172 may be the outer portion 172*b* (FIG. 13) of the support 172. A thickness t of the filter 103 may be smaller than the width Bw of the grille assembly 170. A half of a difference between the thickness t of the filter 103 and the width Bw of the grille assembly 170 may be greater than the gap G between the second central axis Of and the first central axis Ob.

A portion between the inner circumferential surface 103*a* and the outer circumferential surface 103*b* of the filter 103 may be provided below a portion between the inner end of the bell mouth 171 and the outer end of the supporter 172. In the up-down direction, all portions between the inner circumferential surface 103*a* and the outer circumferential surface 103*b* of the filter 103 may overlap or be aligned with the portion between the inner end of the bell mouth 171 and the outer end of the supporter 172.

Even when the second central axis Of is biased forward with respect to the first central axis Ob, the inner circumferential surface 103*a* of the filter 103 may be provided outside of the inner end of the bell mouth 171. The outer circumferential surface 103*b* of the filter 103 may be provided inside of the outer end of the supporter 172 such that interference with the flow of air passing through the filter 103 may be reduced or minimized.

This application is related to U.S. application Ser. No. 17/190,692 filed Mar. 3, 2021 and now issued as U.S. Pat. No. 11,473,593, U.S. application Ser. No. 17/191,873 filed Mar. 4, 2021 and now issued as U.S. Pat. No. 11,754,090, U.S. application Ser. No. 17/197,918 filed Mar. 10, 2021 and now issued as U.S. Pat. No. 11,767,852, U.S. application Ser. No. 17/318,222 filed May 12, 2021 and now issued as U.S. Pat. No. 11,655,826, U.S. application Ser. No. 17/332,681 filed May 27, 2021 and now issued as U.S. Pat. No. 11,739,760, U.S. application Ser. No. 17/318,242 filed May 12, 2021, U.S. application Ser. No. 17/318,274 filed May 12, 2021 and now issued as U.S. Pat. No. 11,624,369, U.S. application Ser. No. 17/335,856 filed Jun. 1, 2021 and now issued as U.S. Pat. No. 11,708,997, U.S. application Ser. No. 17/336,517 filed Jun. 2, 2021 and now issued as U.S. Pat. No. 11,536,283, and U.S. application Ser. No. 17/335,902 filed Jun. 1, 2021 and now issued as U.S. Pat. No. 11,542,956, whose entire disclosures are incorporated by reference herein.

Embodiments disclosed herein may provide a blower that blows or guides air by using the Coanda effect. The blower may be capable of allowing a filter to be installed and removed easily. According to at least one of the embodiments disclosed herein, the blower may be capable of increasing or maximizing a volume of a filter in a space where the filter is installed. The blower may be capable of reducing or minimizing flow resistance of air directed from a filter toward a fan.

The blower may be capable of blocking a user's finger from entering a fan through a grille. The blower may be capable of reducing noise or an increased air flow resistance which is caused by the use of a grille. The blower may be capable of preventing scattering of air through a gap between a fan and a bell mouth, or reducing or minimizing re-entry of air into the fan after the air is discharged from the fan.

Embodiments disclosed herein may be implemented as a blower including a lower body which extends to be relatively long and having a suction hole through which air passes, a fan provided inside the lower body and causing a flow of air, and a filter provided inside the lower body, positioned upstream of the fan, and which extends long in a longitudinal direction of the lower body. A longitudinal axis of the filter may be biased with respect to a longitudinal axis of the lower body.

The blower may further include columns provided between an outer side of the filter and an inner side of the lower body and extending in a longitudinal direction of the filter. The columns may be in contact with the outer side of the filter. The columns may be provided within a range of 180 degrees in a circumferential direction of the filter with respect to the longitudinal axis of the filter.

The columns may include a first column provided behind the filter, a second column provided on or at a left side of the filter, and a third column provided on or at a right side of the filter. A gap or distance between a rear end of the second column and a rear end of the third column may be smaller than an outer diameter of the filter. A gap or distance between a front end of the second column and a front end of the third column may be greater than or equal to the outer diameter of the filter.

The longitudinal axis of the filter may be aligned with the longitudinal axis of the lower body in a front-rear direction and may be provided in front of the longitudinal axis of the lower body.

The filter may have a cylindrical shape, and each of the second column and the third column may include a support section extending along an arc. A curvature of the support section may be equal to a curvature of the outer circumferential surface of the filter. An entry section may extend in a straight line. A gap or distance between the entry section of the second column and the entry section of the third column may increase from a rear side toward a front side. An imaginary straight line extending along a boundary of the entry section and the support section of the second column may intersect the longitudinal axis of the lower body.

The blower may further include a base provided under the lower body, coupled to the lower body, and having a portion provided inside the lower body, and at least one holder which is provided at an upper side of the base and to which the columns are coupled. The filter and the columns may be provided on the base.

The base may have a circular transverse cross-section. The holder may be aligned with the columns in a radial direction of the base. The longitudinal axis of the lower body may be coaxial with the longitudinal axis of the base and a rotational central axis of the fan.

The column may include an outer wall facing an inner circumferential surface of the lower body, an inner wall facing an outer circumferential surface of the filter and coupled to the outer wall, a partition wall provided between the outer wall and the inner wall and dividing a space between the outer wall and the inner wall into at least two sub-spaces, and a cable provided in the at least two sub-spaces.

The blower may further include a bell mouth provided above the filter and having an inlet port to provide air to the fan. The filter may include a hole formed through the filter in a vertical direction. A diameter of the inlet port may be smaller than a diameter of the hole. All regions of the inlet port may overlap or align with the hole in the vertical direction.

The blower may further include a grille provided under the bell mouth and coupled to the bell mouth at a bottom of the bell mouth. The bell mouth may further include a groove which is recessed upwardly from a lower side of the bell mouth and to which the grille is coupled. A position of a lower end of the grille may be equal to or higher than a position of a lower end of the bell mouth.

The bell mouth may have a ring shape and may further include a supporter or support which extends in a radial direction of the bell mouth from an outer circumferential surface of the bell mouth, and to which the grille is coupled. The supporter may be connected or coupled to an inner circumferential surface of the lower body.

The filter may have a cylindrical shape. A thickness of the filter may be smaller than a distance between an inner end of the bell mouth and an outer end of the supporter.

The supporter may include an inner part or portion and an outer part or portion. The inner part may form an inner end of the supporter and form a step with respect to the bell mouth. The outer part may form the outer end of the supporter and form a step with respect to the inner part. The inner part may face an upper side of the filter, and a trap may be formed among the bell mouth, the inner part, the outer part, and the filter.

The bell mouth may further include a first part or portion and a second part or portion. The first part may extend upward from a lower end of the bell mouth and form an inner diameter of the bell mouth. The second part may extend upward from the lower end of the bell mouth and form an outer diameter of the bell mouth. A lower end of the fan may be provided between the first part and the second part. A position of the lower end of the fan may be lower than a position of an upper end of the first part and an upper end of the second part.

The bell mouth may further include a protruding portion protruding upward from an upper end of the second par, and extending along a circumferential direction of the bell mouth. The supporter may be provided below the protruding portion.

Embodiments disclosed herein may be implemented as a blower comprising a case having a suction hole and a discharge hole, the case having a lower body and at least one tower extending in a first direction, a fan provided inside the case and configured to suction air through the suction hole and discharge air out of the discharge hole, and a filter provided inside the case between the fan and the suction hole and extending in the first direction. A longitudinal center axis of the filter may be displaced by a prescribed difference from a longitudinal center axis of the lower body.

A plurality of columns may be provided between an outer side of the filter and an inner side of the case. The columns may extend in the first direction and may be in contact with the outer side of the filter.

The columns of the plurality of columns may be provided within a range of 180 degrees in a circumferential direction of the filter with respect to the longitudinal axis of the filter. The plurality of columns may include a first column provided at a first side of the filter, a second column provided at a second side of the filter and having a first end and a second end, and a third column provided at a third side of the filter and having a first end and a second end, a second direction from the second side to the third side of the filter being perpendicular to the first direction. A distance between the first end of the second column and the first end of the third column may be smaller than an outer diameter of the filter. A distance between the second end of the second column and the second end of the third column may be greater than or equal to the outer diameter of the filter.

In a third direction perpendicular to the first and second directions, the longitudinal center axis of the filter may be aligned with the longitudinal center axis of the lower body and may be provided at a first side of the longitudinal center axis of the lower body.

The filter may be a cylindrical shape. Each of the second column and the third column may include a support section having a curvature equal to a curvature of an outer circumferential surface of the filter and an entry section having at least one flat surface extending in a straight line with respect to the support section. A gap between the entry section of the second column and the entry section of the third column may increase in a third direction.

An imaginary straight line extending, in the second direction, from a position where the entry section of the second column meets the support section of the second column may intersect the longitudinal center axis of the lower body.

A base may be provided under and coupled to the lower body, the base may have a portion provided inside the lower body. At least one holder may be provided at an upper side of the base and to which the plurality of columns may be coupled. The filter and the columns may be provided on the base.

The base may have a circular cross-section, and the holder may be aligned with the columns in a radial direction of the base. The longitudinal axis of the case may be coaxial with a longitudinal axis of the base and a rotational central axis of the fan.

Each column in the plurality of columns may include an outer wall facing an inner surface of the case, an inner wall facing an outer surface of the filter and coupled to the outer wall, a partition wall provided between the outer wall and the inner wall to divide a space between the outer wall and the inner wall into at least two sections, and a cable provided in the space.

A bell mouth may be provided above the filter and having an inlet port through which air passes. The filter may comprise a hole extending in the first direction. A diameter of the inlet port may be smaller than a diameter of the hole. In the first direction, the inlet port may align with the hole.

A grille may be provided under the bell mouth and coupled to the bell mouth. A lower side of the bell mouth may include a groove to which the grille may be coupled, and a position of a lower end of the grille may be equal to or higher than a position of a lower end of the bell mouth.

The bell mouth may have a ring shape and may include a support which extends from an outer surface of the bell mouth in a radial direction of the bell mouth. The support may be coupled to an inner surface of the case and the grille.

The filter may have a cylindrical shape. A thickness of the filter may be smaller than a distance between an inner end of the bell mouth and an outer end of the support.

The support may comprise an inner portion forming an inner end of the support and stepped with respect to the bell mouth, the inner portion facing an upper side of the filter, an outer portion forming an outer end of the support and stepped with respect to the inner portion, and a trap formed among the bell mouth, the inner part, the outer part, and the filter.

The bell mouth may further comprise a first portion extending upward from a lower end of the bell mouth and forming an inner diameter of the bell mouth, and a second portion extending upward from the lower end of the bell mouth and forming an outer diameter of the bell mouth. A lower end of the fan may be provided between the first portion and the second portion of the bell mouth. A position of the lower end of the fan may be lower than a position of an upper end of the first portion and an upper end of the second portion. The bell mouth may further include a protruding portion protruding upward from an upper end of the second portion and extending along a circumferential direction of the bell mouth. The support may be provided below the protruding portion.

Certain embodiments or other embodiments of the disclosure described above are not mutually exclusive or distinct from each other. Any or all elements of the embodiments of the disclosure described above may be combined or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

A detailed description of known arts will be omitted if it is determined that the detailed description of the known arts can obscure the embodiments of the invention. The accompanying drawings are used to help easily understand various technical features, and it should be understood that the embodiments presented herein are not limited by the accompanying drawings. As such, the present disclosure should be construed to extend to any alterations, equivalents and substitutes in addition to those which are particularly set out in the accompanying drawings.

In the drawings, directions, such as up (U), down (D), left (L), and right (R), are shown merely for convenience of explanation, and the scope of the present disclosure is not limited thereto.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A blower, comprising:

a lower body having a suction hole and extending in vertical direction;

an upper body disposed above the lower body and having a discharge slit extending in vertical direction, wherein the discharge slit is biased with respect to a longitudinal axis of the lower body to a first direction;

a fan provided inside the lower body and configured to suction air through the suction hole and discharge air out of the discharge slit;

a filter provided inside the lower body between the fan and the suction hole and extending in vertical direction, and having a cylindrical shape with a central hole penetrating the filter in vertical direction, wherein a longitudinal center axis of the filter is biased with respect to the longitudinal center axis of the lower body to a second direction opposite to the first direction; and a plurality of columns provided between an outer side of the filter and an inner side of the lower body, and wherein the filter is detachable through front side of the lower body, and wherein the plurality of columns include:

a first column provided at a rear side of the filter;

a second column provided at a left side of the filter and having a rear end and a front end; and a third column provided at a right side of the filter and having a rear end and a front end, a left-right direction from the left side to the right side of the filter being perpendicular to the vertical direction, and wherein:

a distance between the rear end of the second column and the rear end of the third column is smaller than an outer diameter of the filter; and a distance between the front end of the second column and the front end of the third column is greater than or equal to the outer diameter of the filter.

2. The blower of claim 1, wherein the plurality of columns extend in the vertical direction and are in contact with the outer side of the filter.

3. The blower of claim 2, wherein the plurality of columns are provided within a range of 180 degrees in a circumferential direction of the filter with respect to the longitudinal axis of the filter.

4. The blower of claim 3, further comprising:

a base provided under and coupled to the lower body, the base having a portion provided inside the lower body; and at least one holder provided at an upper side of the base and to which the plurality of columns is coupled, wherein the filter and the plurality of columns are provided on the base.

5. The blower of claim 3, wherein each column in the plurality of columns includes:

an outer wall facing an inner surface of the lower body;

an inner wall facing an outer surface of the filter and coupled to the outer wall;

a partition wall provided between the outer wall and the inner wall to divide a space between the outer wall and the inner wall into at least two sections; and a cable provided in the space.

6. The blower of claim 4, wherein:

the base has a circular cross-section; and the holder is aligned with the plurality of columns in a radial direction of the base.

7. The blower of claim 4, wherein the longitudinal axis of the lower body is coaxial with a longitudinal axis of the base and a rotational central axis of the fan.

8. The blower of claim 1, the longitudinal center axis of the filter is aligned with the longitudinal center axis of the lower body and is provided at a front side of the longitudinal center axis of the lower body.

9. The blower of claim 1, wherein each of the second column and the third column includes:

a support section having a curvature equal to a curvature of an outer circumferential surface of the filter, and an entry section having at least one flat surface extending in a straight line with respect to the support section, wherein a gap between the entry section of the second column and the entry section of the third column increases in a third direction.

10. The blower of claim 9, wherein an imaginary straight line extending, in the left-right direction, from a position where the entry section of the second column meets the support section of the second column intersects the longitudinal center axis of the lower body.

11. The blower of claim 1, further comprising a bell mouth provided above the filter and having an inlet port through which air passes, wherein:

a diameter of the inlet port is smaller than a diameter of the central hole.

12. The blower of claim 11, wherein in the vertical direction, the inlet port aligns with the central hole.

13. The blower of claim 11, further comprising a grille provided under the bell mouth and coupled to the bell mouth.

14. The blower of claim 13, wherein a lower side of the bell mouth includes a groove to which the grille is coupled, and a position of a lower end of the grille is equal to or higher than a position of a lower end of the bell mouth.

15. The blower of claim 13, wherein the bell mouth has a ring shape and includes a support which extends from an outer surface of the bell mouth in a radial direction of the bell mouth, and wherein the support is coupled to an inner surface of the lower body and the grille.

16. The blower of claim 15, wherein:

a thickness of the filter is smaller than a distance between an inner end of the bell mouth and an outer end of the support.

17. The blower of claim 15, wherein the support comprises:

an inner portion forming an inner end of the support and stepped with respect to the bell mouth, the inner portion facing an upper side of the filter;

an outer portion forming an outer end of the support and stepped with respect to the inner portion; and a trap formed among the bell mouth, the inner part, the outer part, and the filter.

18. The blower of claim 15, wherein the bell mouth further comprises:

a first portion extending upward from a lower end of the bell mouth and forming an inner diameter of the bell mouth; and a second portion extending upward from the lower end of the bell mouth and forming an outer diameter of the bell mouth, wherein:

a lower end of the fan is provided between the first portion and the second portion of the bell mouth; and a position of the lower end of the fan is lower than a position of an upper end of the first portion and an upper end of the second portion.

19. The blower of claim 18, wherein the bell mouth further comprises a protruding portion protruding upward from an upper end of the second portion and extending along a circumferential direction of the bell mouth, wherein the support is provided below the protruding portion.

* * * * *